US006961526B2

(12) United States Patent
Tezuka et al.

(10) Patent No.: US 6,961,526 B2
(45) Date of Patent: Nov. 1, 2005

(54) IMAGE FORMING APPARATUS WHICH PERFORMS IMAGE FORMATION CONTROL BASED ON THE IMAGE AFTER FIXING

(75) Inventors: Hiroki Tezuka, Kanagawa (JP); Toshiki Nakayama, Shizuoka (JP); Seiji Uchiyama, Shizuoka (JP); Yoichiro Maebashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 10/340,682

(22) Filed: Jan. 13, 2003

(65) Prior Publication Data

US 2003/0138261 A1 Jul. 24, 2003

(30) Foreign Application Priority Data

Jan. 24, 2002 (JP) ..... 2002-015933

(51) Int. Cl.[7] ..... G03G 15/00
(52) U.S. Cl. ..... 399/15; 399/49; 399/72
(58) Field of Search ..... 399/39–41, 49, 399/72, 309, 401, 402, 15

(56) References Cited

U.S. PATENT DOCUMENTS 4,655,582 A * 4/1987 Okuda et al. ..... 399/402
4,825,250 A 4/1989 Miyata et al.
4,999,674 A 3/1991 Miyata et al.
5,339,137 A 8/1994 Kusumoto et al.
5,839,016 A * 11/1998 Folkins et al. ..... 399/401 X
5,887,223 A * 3/1999 Sakai et al. ..... 399/49 X
6,243,542 B1 * 6/2001 Fujimoto et al. ..... 399/72
6,327,453 B1 * 12/2001 Imaizumi et al. ..... 399/49 X
2001/0043817 A1 11/2001 Maebashi ..... 399/50

* cited by examiner

*Primary Examiner*—William J. Royer
(74) *Attorney, Agent, or Firm*—Fitzpatrick, Cella, Harper & Scinto

(57) ABSTRACT

An image forming apparatus is provided in which, by detecting an image formed on a recording medium, at least one of the density and chromaticity of the image can be properly controlled. The image forming apparatus includes an image forming unit for forming a toner image on an image carrier, a transfer unit for transferring the toner image formed by the image forming unit onto a transfer material in a transfer position, a fusing unit for fusing the toner image transferred by the transfer unit on the transfer material, a feed-direction changing unit for changing over a feed direction of the transfer material so that the transfer material having the toner image fused by the fusing unit is reversed and fed to the transfer position, a detecting unit for detecting, in a predetermined detecting position, the toner image fused on the transfer material by the fusing unit, and a control unit for controlling the image forming unit based on result detected by the detecting unit.

20 Claims, 16 Drawing Sheets

IMAGE FORMING APPARATUS WHICH PERFORMS IMAGE FORMATION CONTROL BASED ON THE IMAGE AFTER FIXING

BACKGROUND OF THE INVENTION

1. Field of the Invention

The present invention relates to an image forming apparatus, such as a printer and a copying machine, for forming an image on a recording medium.

2. Description of the Related Art

Hitherto, an electrophotographic image forming apparatus is known in which an electrostatic latent image is formed on an electrophotographic photoconductor (referred to simply as a "photoconductor" hereinafter), serving as an image carrier, with exposure of, e.g., a laser beam emitted in response to an image signal, the electrostatic latent image is visualized into a developer (toner) image using a developer, and a hard image is obtained by transferring the toner image onto a transfer material and then fusing it.

Also, an electrophotographic image forming apparatus for forming a color image is known in which developer (toner) images of multiple colors formed on a photoconductor are successively transferred onto a recording medium (also referred to as a "transfer material" hereinafter), or in which developer (toner) images of multiple colors formed on a photoconductor are primary-transferred onto an intermediate transfer member and then secondary-transferred onto a transfer material, whereby a color toner image is formed on the transfer material.

In an electrophotographic image forming apparatus, if variations occur in performance of apparatus components with changes of environment around the apparatus and use of the apparatus for a long period, the density of a toner image formed on a transfer material by the image forming apparatus also varies. In an electrophotographic image forming apparatus for forming a color image, particularly, there is a risk that a color balance is lost even with a slight variation in density of the toner image. It is hence desired to keep constant the image density and gradation characteristics at all times regardless of variations in performance of the apparatus components.

In an image forming apparatus for forming a color image, therefore, a method for keeping constant the image density and gradation characteristics (i.e., color balance) at all times is proposed and comprises, for example, the step of changing process conditions such as an amount of laser exposure and a development bias, or adjusting the compensation factors set in a lookup table (LUT) which is used to modify an image signal for forming an electrostatic latent image on a photoconductor with the laser exposure, depending on changes of environment (e.g., absolute temperature) around the apparatus and variations in performance of the apparatus components.

Also, as a method for ensuring constant the image density and gradation characteristics in spite of variations in performance of the components of the image forming apparatus, it is conceivable to form a pattern of a reference developer image (referred to as a "toner patch" hereinafter) for density detection on a photoconductor or an intermediate transfer member, and to detect the density of the toner patch with a photosensor. That method enables the image density and gradation characteristics (i.e., color balance) to be kept constant at all times by changing process conditions such as an amount of laser exposure and a development bias, or by modifying an image signal based on a lookup table (LUT) which is used to modify the image signal for forming an electrostatic latent image on a photoconductor with the laser exposure, in accordance with a result detected by a photosensor.

In the above-mentioned toner image density control using a photosensor, however, the density is detected using a toner patch formed on the photoconductor or the intermediate transfer member, and the control is not intended to compensate for a change in image color balance caused by transferring and fusing a toner image onto a transfer material. Further, it is known that the image color balance is also changed depending on not only the efficiency in transfer of a toner image onto a transfer material, but also heat and pressure applied during the fusing.

SUMMARY OF THE INVENTION

In the view of the state of the art mentioned above, it is an object of the present invention to provide an improved image forming apparatus.

Another object of the present invention is to provide an image forming apparatus in which, by detecting an image formed on a recording medium, at least one of the density and chromaticity of the image can be properly controlled.

To achieve the above objects, the present invention provides an image forming apparatus comprising an image forming unit for forming a toner image on an image carrier; a transfer unit for transferring the toner image formed by the image forming unit onto a transfer material in a transfer position; a fusing unit for fusing the toner image transferred by the transfer unit on the transfer material; a feed-direction changing unit for changing over a feed direction of the transfer material so that the transfer material having the toner image fused by the fusing unit is reversed and fed to the transfer position; a detecting unit for detecting, in a predetermined detecting position, the toner image fused on the transfer material by the fusing unit, the predetermined detecting position being a certain position near the transfer position in the middle of a feed path of the transfer material within a region after the feed direction of the transfer material has been changed over by the feed-direction changing unit; and a control unit for controlling the image forming unit based on a result detected by the detecting unit.

Further objects, features and advantages of the present invention will become apparent from the following description of the preferred embodiments with reference to the attached drawings.

DESCRIPTION OF THE PREFERRED EMBODIMENTS

An image forming apparatus according to the present invention will be described below with reference to the drawings.

Figure 1:
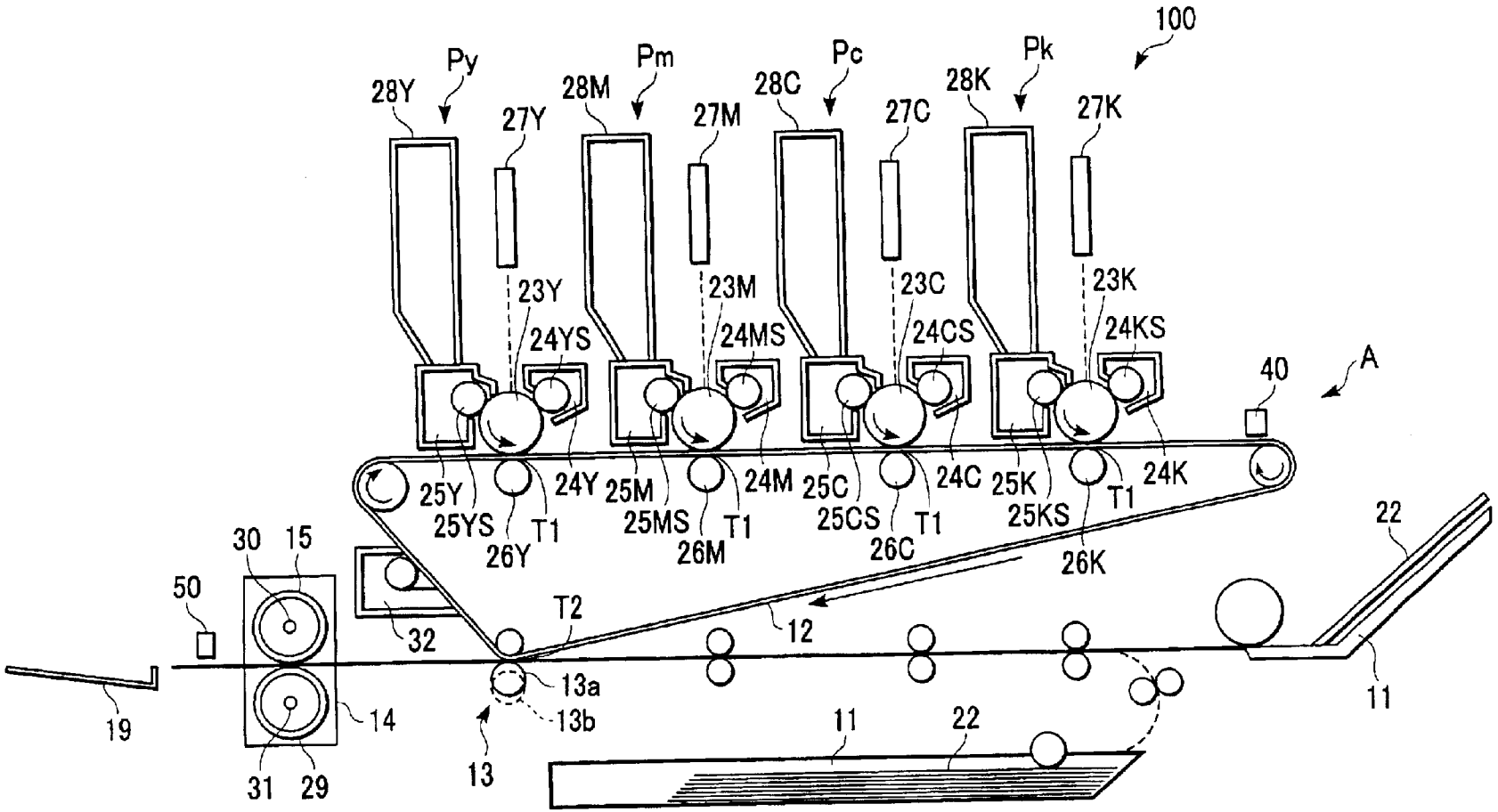
FIG. 1 is a schematic view of an electrophotographic image forming apparatus.

FIG. 1 represents one example of an image forming apparatus capable of forming a full color image, and shows an outline of a tandem image forming apparatus 100 employing an intermediate transfer member 12. The general operation of the electrophotographic image forming apparatus will be described with reference to FIG. 1.

The image forming apparatus 100 shown in FIG. 1 receives an image signal from an external host, such as a personal computer, connected to an apparatus body in a communicable manner, or from a document reader (not shown) separately provided in association with the image forming apparatus 100. In the image forming apparatus 100, an electrostatic latent image is formed on a photoconductor drum 23 (23K, 23C, 23M and 23Y) with exposure of a laser beam emitted in accordance with the image signal. A toner stored in a developing unit 25 (25K, 25C, 25M and 25Y) is applied to the electrostatic latent image to form a monochrome toner image for each of multiple colors. These monochrome toner images are successively superimposed one above another on the intermediate transfer member 12 to form a color toner image. The color toner image is transferred onto a transfer material 22. Further, in the image forming apparatus 100, the color toner image transferred onto the transfer material 22 is fused on the transfer material 22 by a fusing unit 14. Thereafter, the transfer material 22 is ejected out of the image forming apparatus 100.

An image forming section A has stations Py, Pm, Pc and Pk arranged in tandem corresponding to the number of colors (four, i.e., yellow, magenta, cyan and black) of toners used in development to form a superimposed color toner image. Each station comprises a photoconductor drum 23 (23Y, 23M, 23C or 23K) serving as an image carrier in the form of a drum, a primary charging unit 24 (24Y, 24M, 24C or 24K), a developing unit 25 (25Y, 25M, 25C or 25K), a primary transfer unit 26 (26Y, 26M, 26C or 26K), a scanner section 27 (27Y, 27M, 27C or 27K), and a developer resupply container (toner cartridge) 28 (28Y, 28M, 28C or 28K). The image forming section A also includes the intermediate transfer member 12 serving as an image carrier, which is moved relative to each of the stations Py, Pm, Pc and Pk. The image forming apparatus 100 further includes sheet feed sections 11, a secondary transfer roller 13 serving as a secondary transfer unit, a fusing unit 14, a cleaning unit 32, and so on.

Figure 6:
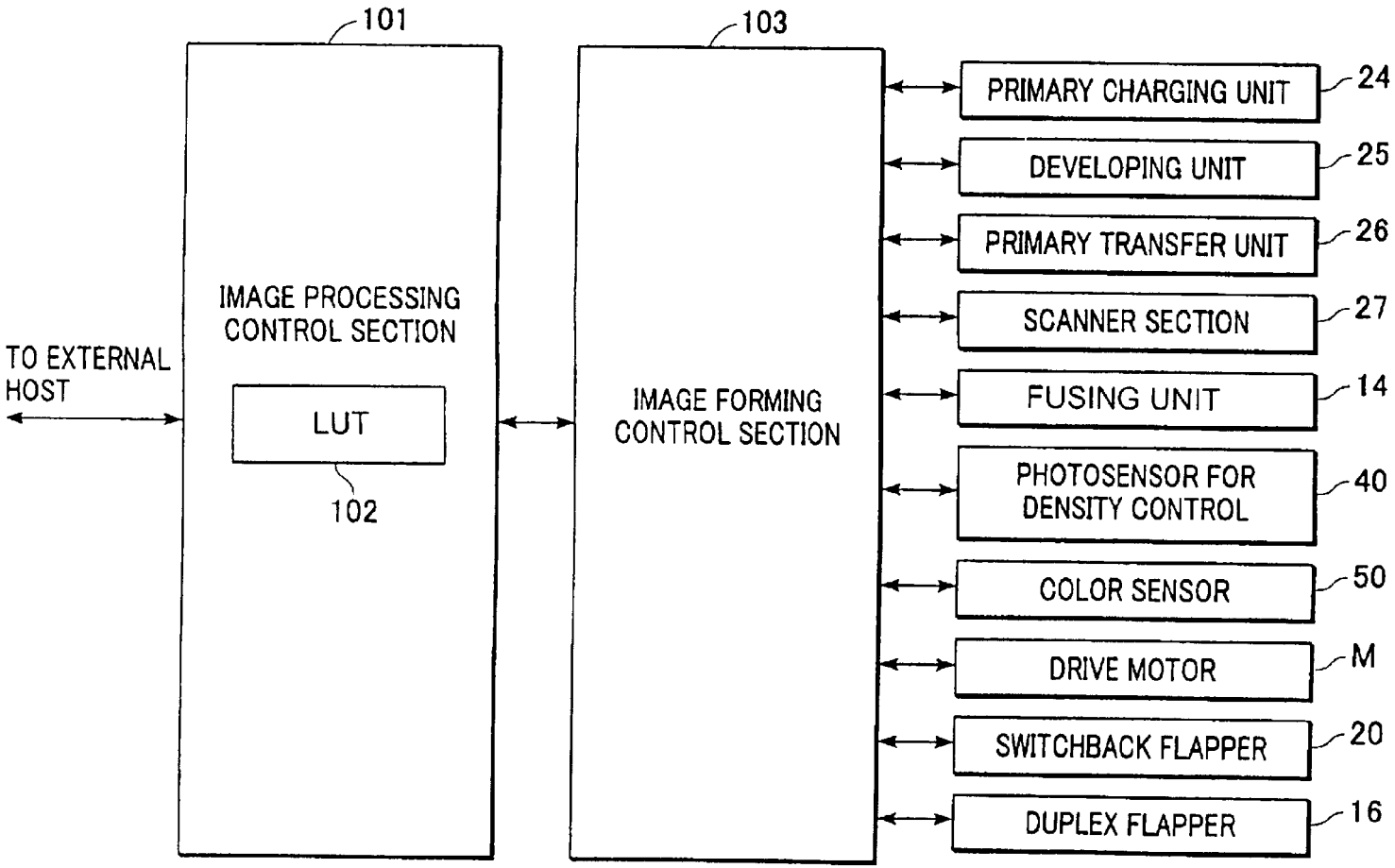
FIG. 6 is a block diagram showing a control configuration of the image forming apparatus according to the first embodiment of the present invention.

In addition, each of the photoconductor drums 23Y, 23M, 23C and 23K is constituted by coating an organic photoconductive layer on an outer circumferential surface of an aluminum cylinder, and is rotated by driving forces transmitted from a drive motor M (FIG. 6). The drive motor M rotates the photoconductor drums 23Y, 23M, 23C or 23K in a direction of arrow in FIG. 1 (counterclockwise) in sync with the image forming operation.

The image forming apparatus 100 includes four injection chargers 24Y, 24M, 24C and 24K which are provided respectively in the stations Py, Pm, Pc and Pk and serve as the primary charging units 24 for electrically charging the photoconductor drums 23Y, 23M, 23C and 23K. The injection chargers 24Y, 24M, 24C and 24K have, as charging members, charging sleeves 24YS, 24MS, 24CS and 24KS.

In the image forming apparatus 100, exposure beams are irradiated from the scanner sections 27Y, 27M, 27C and 27K to the photoconductor drums 23Y, 23M, 23C and 23K for selective exposure of the surfaces of the photoconductor drums 23Y, 23M, 23C and 23K which have been uniformly charged. Electrostatic latent images are thereby formed on the surfaces of the photoconductor drums 23Y, 23M, 23C and 23K corresponding to respective image signals.

The image forming apparatus 100 includes four developing units 25Y, 25M, 25C and 25K for development in respective colors, i.e., yellow (Y), magenta (M), cyan (C) and black (B), which are provided respectively in the stations Py, Pm, Pc and Pk and serve as the developing units for visualizing the respective electrostatic latent images formed on the photoconductor drums 23Y, 23M, 23C and 23K. The developing units 25Y, 25M, 25C and 25K include developing sleeves 25YS, 25MS, 25CS and 25KS that serve as developing members (developer carriers) for applying developers to the photoconductor drums 23Y, 23M, 23C and 23K and for supplying the toners as the developers. The developing units 25Y, 25M, 25C and 25K are detachably attached to the apparatus body.

Further, in the image forming apparatus 100, an endless belt running over a plurality of rollers is used as the intermediate transfer member 12. The intermediate transfer member 12 is in contact with the photoconductor drums 23Y, 23M, 23C and 23K and is rotated (circulated) in a direction of arrow in FIG. 1 (clockwise) with rotations of the photoconductor drums 23Y, 23M, 23C and 23K. Then, in a transfer section (primary transfer section) T1 of the image forming apparatus 100 in which primary transfer rollers 26Y, 26M, 26C and 26K serving as the primary transfer units are positioned respectively opposite to the photoconductor drums 23Y, 23M, 23C and 23K, the respective monochrome toner images formed in the stations Py, Pm, Pc and Pk are successively transferred onto the circulating intermediate transfer member 12 in a superimposed relation. Thereafter, in the image forming apparatus 100, the multi-color toner image having been transferred onto the intermediate transfer member 12 is transferred onto a transfer material 22 that is fed to pass through a nip between the secondary transfer roller 13 and the intermediate transfer member 12 in a secondary transfer section T2. The transfer material 22 is, e.g., a recording sheet or an OHP sheet. In the image forming apparatus 100, the transfer materials 22 are supplied one by one from the sheet feed sections 11 and fed to the secondary transfer section T2 in sync with formation of the toner images on the intermediate transfer member 12.

In the image forming apparatus 100, when the multi-color toner image is transferred onto the transfer material 22, the secondary transfer roller 13 is brought into contact with the transfer material 22 in a position as indicated by a solid line 13*a* in FIG. 1, but it is moved away from the secondary transfer roller 13 to a position as indicated by a dotted line 13*b* after the end of the image forming process.

A fusing section constituting the fusing unit 14 fuses, for fixation under heating, the multi-color toner image having been transferred onto the transfer material 22 while feeding the transfer material 22. As shown in FIG. 1, the fusing unit 14 comprises a fusing roller 15 for heating the transfer material 22, and a pressing roller 29 for bringing the transfer material 22 into pressure contact with the fusing roller 15. The fusing roller 15 and the pressing roller 29 have hollow inner spaces in which heaters 30, 31 are disposed. The fusing roller 15 and the pressing roller 29 cooperate to feed the transfer material 22, having the multi-color toner image formed thereon, between them, and apply heat and pressure to the transfer material 22 for fusing the toner image on the surface of the transfer material 22.

In the image forming apparatus 100, after fusing the toner image on the transfer material 22, the transfer material 22 is advanced to a sheet ejection section 19 and the image forming operation is brought to an end.

The cleaning unit 32 serves to clean the toner remaining on the intermediate transfer member 12 after the toner image has been transferred from the intermediate transfer member 12 onto the transfer material 22. In the cleaning unit 32, waste toners left after transferring, onto the transfer material 22, the four-color toner images formed on the intermediate transfer member 12 are stored in a cleaner container.

Figure 2A:
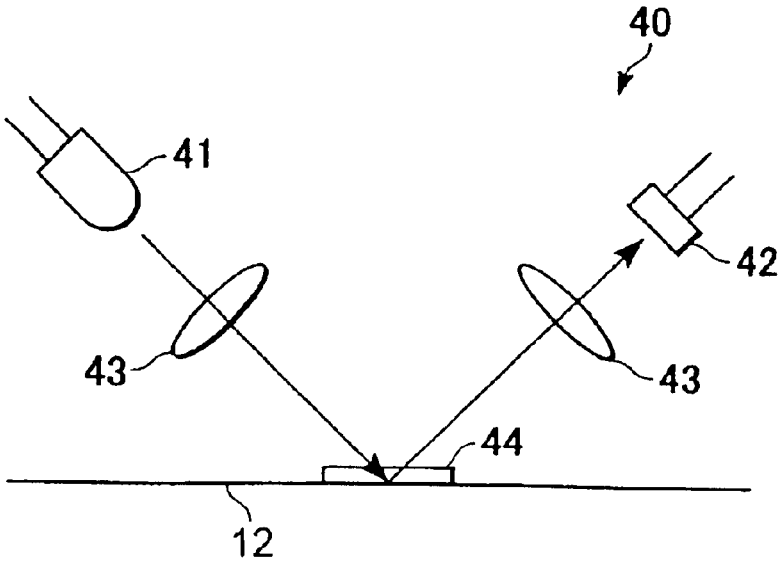
FIGS. 2A and 2B are each a schematic view of a photosensor for density control used in the image forming apparatus.
Figure 2B:
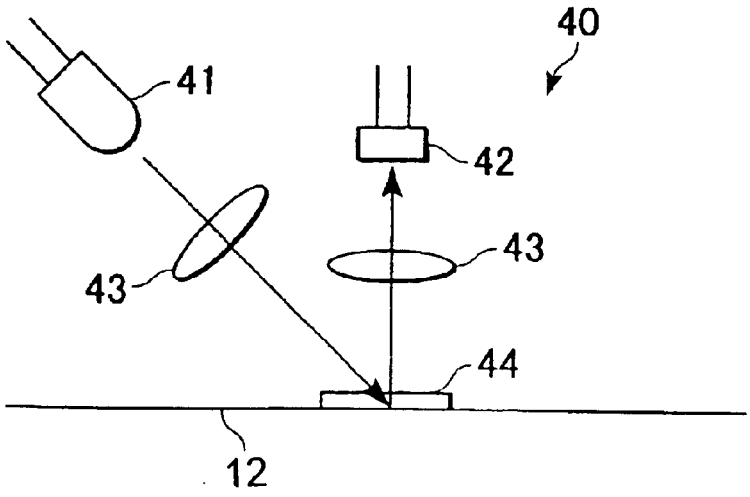

In the image forming apparatus 100 of FIG. 1, a photosensor 40 for density control is disposed to face the intermediate transfer member 12, and measures the density of a toner density patch pattern 44 formed on the surface of the intermediate transfer member 12. FIGS. 2A and 2B show examples of the photosensor 40 for density control. The photosensor 40 for density control comprises a light emitting device 41 such as an LED (Light Emitting Diode), a light receiving device 42 such as a photodiode or CdS, optical elements 43 for optically coupling the light emitting device 41 and the light receiving device 42, an IC (not shown) as a signal processing unit for processing received optical data, and a holder (not shown) for housing those components.

The light receiving device 42 shown in FIG. 2A detects both a regularly reflected component and a diffusedly reflected component of a light irradiated from the light emitting device 41 through the optical element 43 to the toner density patch pattern 44 and reflected by it. On the other hand, the light receiving device 42 shown in FIG. 2B detects only a diffusedly reflected component of a light, which is irradiated from the light emitting device 41 through the optical element 43 to the toner density patch pattern 44 and reflected by it, without being affected by specular reflection of the reflected light. Further, temperature and humidity sensors (not shown) may be disposed near the photosensor 40 for density control to measure an absolute temperature and humidity within the image forming apparatus 100.

Density control of the image forming apparatus 100 can be performed based on a result of density detection using the photosensor 40 for density control, shown in FIG. 2A or 2B, and on results detected by the temperature and humidity sensors.

However, the density control using the photosensor 40 for density control implies control in which the toner density patch pattern 44 is formed on the intermediate transfer member 12 of the image forming apparatus 100 and then detected. In the image forming apparatus 100, the toner images formed on the intermediate transfer member 12 are transferred onto the transfer material 22 and fused in the fusing unit 14. Therefore, a color balance of the toner image fused and fixed to the transfer material 22 may vary depending on the transfer efficiency in the transfer process and the heating and/or pressing condition during the fusing.

In view of the above, the present invention intends to propose a method for keeping constant the density and gradation characteristics (i.e., color balance) of the toner image after being fused on the transfer material 22, by detecting the density or chromaticity of the toner image on the transfer material 22 after transferring and fusing the toner image onto the transfer material 22, and then changing process conditions such as an amount of laser exposure and a development bias, or modifying an image signal based on a lookup table (LUT) which is used to modify the image signal for forming the electrostatic latent image on the photoconductor drum 23 with the laser exposure.

A method for detecting the density or chromaticity of the toner image on the transfer material 22 and properly maintaining the density and gradation characteristics (i.e., color balance) of the toner image, according to a first embodiment of the present invention, will be described with reference to the drawings.

Figure 3:
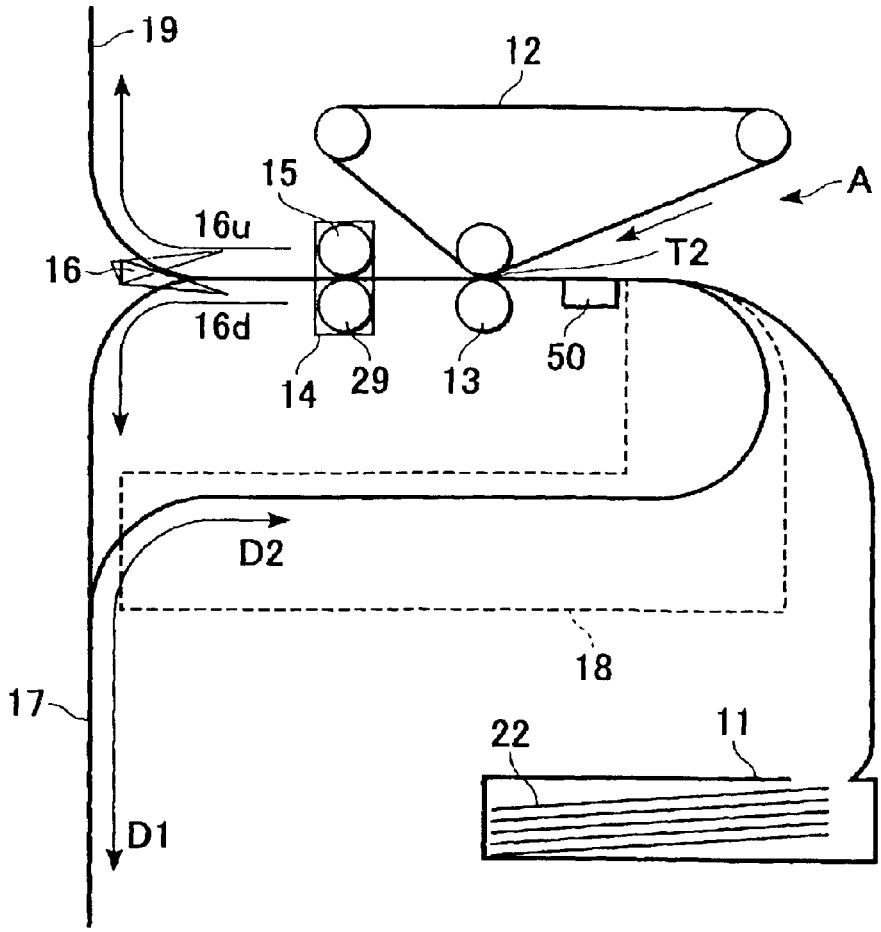
FIG. 3 is a schematic view of an image forming apparatus according to first and second embodiments of the present invention.

FIG. 3 is a schematic view of an image forming apparatus according to the first embodiment of the present invention.

As shown in FIG. 3, in order to form images on both sides of a transfer material 22, an image forming apparatus 100 according to the first embodiment of the present invention includes a switchback mechanism 17 and a duplex unit 18 as indicated by broken lines. The duplex unit 18 may be detachably attached to the image forming apparatus 100 as users require, or it may be built in as a part of the image forming apparatus 100 beforehand.

Also, the image forming apparatus 100 includes a duplex flapper 16 as a means for changing over a feed path of the transfer material 22 after having passed the fusing unit 14. When the duplex flapper 16 is in a downward inclined position as indicated by solid lines 16*d* in FIG. 3, the transfer material 22 is advanced to a sheet ejecting section 19. When the duplex flapper 16 is in an upward inclined position as indicated by solid lines 16*u* in FIG. 3, the transfer material 22 is fed to the switchback mechanism 17.

In the first embodiment, the construction and operation of an image forming section A for forming toner images on the intermediate transfer member 12 with a plurality of image forming units (stations P) and transferring the toner images onto the transfer material 22, and the constructions and operations of a sheet feed section 11, a secondary transfer roller 13 and a fusing unit 14 are the same as those in the image forming apparatus 100 described above with reference to FIG. 1. Therefore, the components having the same functions and constructions are denoted by the same characters and are not described in detail here.

Figure 4A:
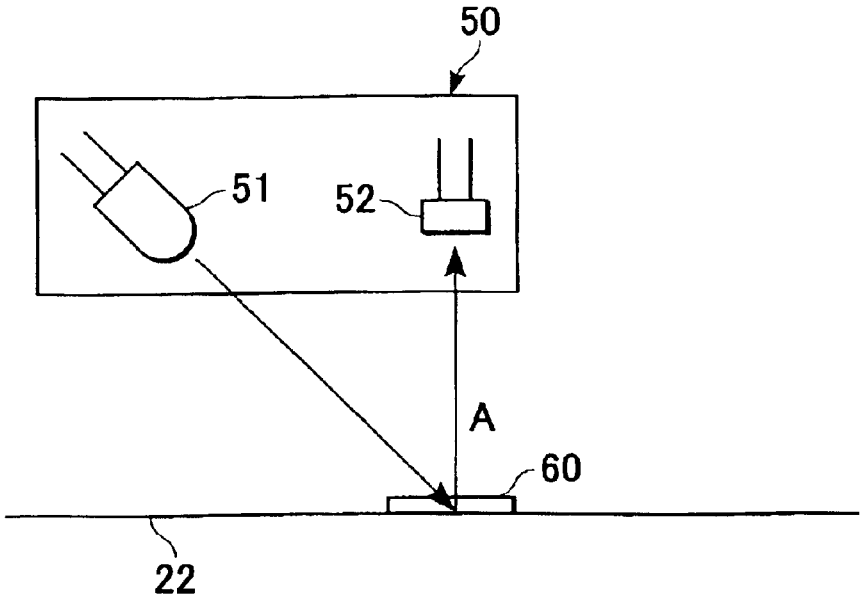
FIGS. 4A and 4B are each a schematic view of a color sensor used in the image forming apparatus.
Figure 4B:
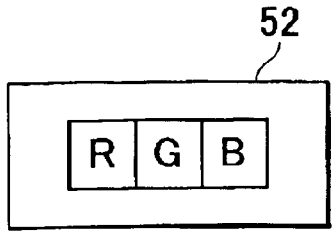

FIG. 4A shows one example of a sensor 50 capable of detecting the density or chromaticity (referred to as a "color sensor" hereinafter). The color sensor 50 comprises a white LED 51 and a charge accumulated sensor 52 with an RGB on-chip filter. A light emitted from the white LED 51 is caused to obliquely enter, at 45 degrees, the transfer material 22 on which a toner patch pattern 60 having been fused is formed, and the charge accumulated sensor 52 with the RGB on-chip filter detects the intensity of diffused light reflected in a direction of 0 degree. FIG. 4B shows the charge accumulated sensor 52 with the RGB on-chip filter as viewed in a direction of arrow A in FIG. 4A. A light receiving portion of the charge accumulated sensor 52 with the RGB on-chip filter has RGB pixels independent of one another. A charge accumulated sensor portion of the charge accumulated sensor 52 with the RGB on-chip filter may be replaced with a photodiode. While a set of three RGB pixels are employed in FIG. 4B, several sets of pixels may be used for each color. Also, while the light emitted from the white LED 51 enters the transfer material 22 at an angle of 45 degrees in FIG. 4A, the angle of incidence may be set to 0 degree and the charge accumulated sensor 52 with the RGB on-chip filter may be disposed in a position corresponding to the angle of reflection of 45 degrees. As an alternative, the color sensor 50 may comprise LEDs emitting lights of three RGB colors and a filter-less sensor. In this case, the filter-less sensor detects an image while the LEDs of three RGB colors are alternately illuminated.

Figure 5:
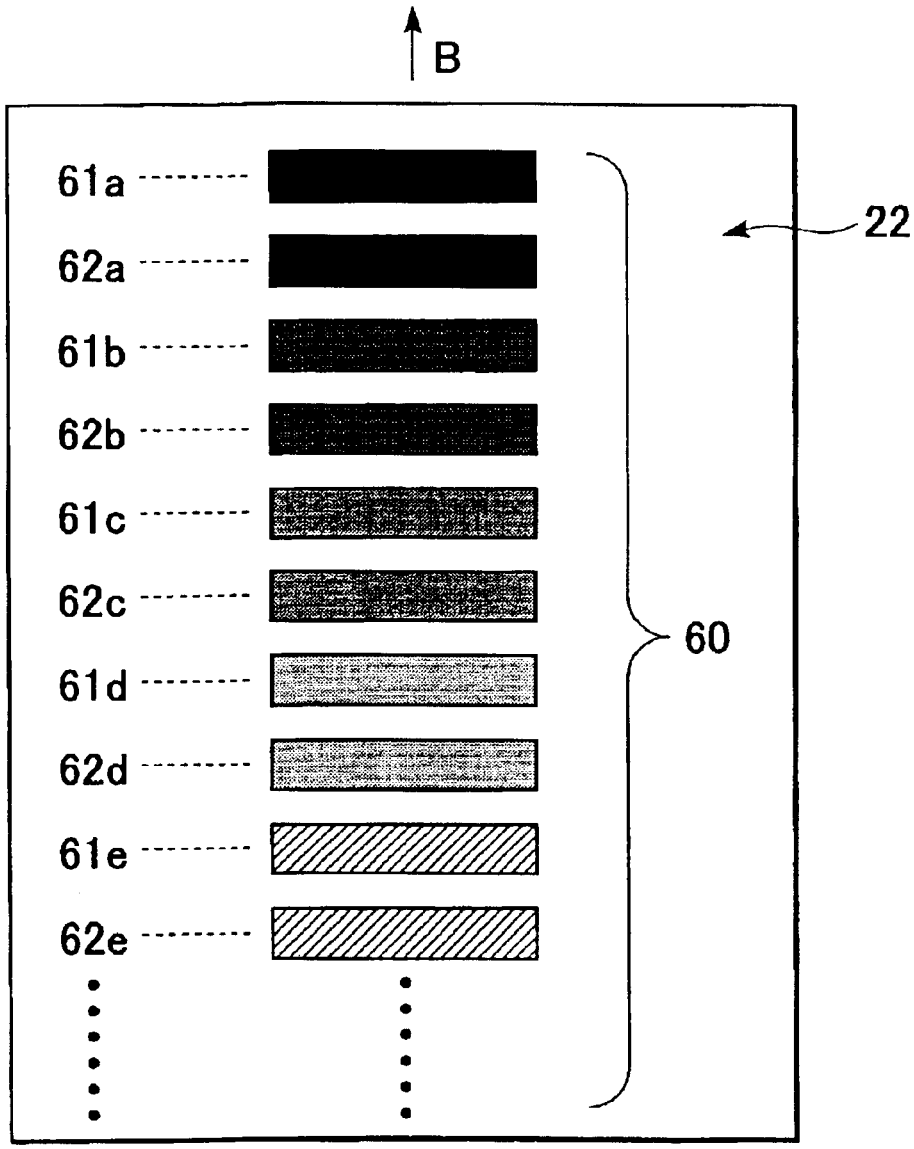
FIG. 5 shows one example of a toner patch pattern formed on a transfer material for density or chromaticity control.

FIG. 5 shows one example of the toner patch pattern 60 formed on the transfer material 22 for density or chromaticity control. The toner patch pattern 60 is usually prepared by continuously forming a plurality of toner patches different in density or chromaticity, such as a plurality of monochrome images different in density or a plurality of full color images different in chromaticity. The density and gradation characteristics (i.e., color balance) of the toner image having been fused on the transfer material 22 can be properly maintained by detecting the density or chromaticity of the toner patch pattern 60.

In the case of employing the color sensor 50 described above, if the color sensor 50 for detecting the density or chromaticity of the toner patch pattern 60 formed on the transfer material 22 after being transferred and fused is disposed on the feed path of the transfer material 22 immediately after (downstream in the feed direction) the fusing unit 14 for the purpose of detecting the density or chromaticity of the toner image on the transfer material 22 after being transferred and fused onto the transfer material 22, an ambient region of the fusing unit 14 surrounding the color sensor 50 is affected by the heat radiated from the fusing unit 14. In other words, the vicinity of the fusing unit 14 is heated to such an extent that the result of detecting the density or chromaticity of the toner patch pattern 60 may vary because of deformations of the optical elements, such as lenses, and the sensor holder constituting the color sensor 50, as well as changes in spectrum and amount of the light emitted from the white LED 51 and changes in spectroscopic sensitivity characteristics of the charge accumulated sensor 52 with the RGB on-chip filter.

Taking into account the above-described drawback, as shown in FIG. 3, the color sensor 50 is disposed in a position sufficiently away from the fusing unit 14 and free from the effect of the heat radiated from the fusing unit 14. As a result, the image forming apparatus 100 of this embodiment can perform control to form the toner image having a stable color balance on the transfer material 22 by detecting the toner patch pattern 60 formed on the transfer material 22.

FIG. 6 is a block diagram showing a control system of the image forming apparatus 100 according to the first embodiment of the present invention.

An image processing control section (image processing controller) 101 receives an image signal from an external host, such as a personal computer, connected to the apparatus body in a communicable manner, or from a document reader (not shown) separately provided in association with the image forming apparatus 100, and also transmits a signal for image formation to a image forming control section 103 (described later).

An LUT 102 is a table for converting the image signal and is employed to modify an image signal received by the image processing control section 101 into an image signal for forming the electrostatic latent image on the photoconductor drum 23 with the laser exposure.

The image forming control section (image forming controller) 103 controls the various components of the image forming apparatus 100. More specifically, the image forming control section 103 controls the image forming section A, which is made up of the primary charging unit 24, the developing unit 25, the primary transfer unit 26, the scanner section 27, the fusing unit 14, the photosensor 40 and the color sensor 50. Information regarding the density or chromaticity detected by the color sensor 50 is input to the image forming control section 103 and further input, through the image forming control section 103, to the image processing control section 101 to be used therein as information for adjusting the LUT 102 that is used to modify the image signal. Further, the image forming control section 103 controls the drive motor M for driving the photoconductor drum 23, the intermediate transfer member 12, the fusing roller 15, and feed rollers (not shown) arranged in the sheet ejecting section 19, the switchback flapper 20, the duplex flapper 16 and the switchback mechanism 17, along the sheet feed path. The drive motor M may be constituted as a single motor in common to the various sections and its driving forces may be transmitted in a properly switched manner. Alternatively, a plurality of drive motors may be disposed in the various sections and controlled independently of one another.

The operation of the image forming apparatus 100 according to the first embodiment will be described with reference to a flowchart of FIG. 7.

Figure 7:
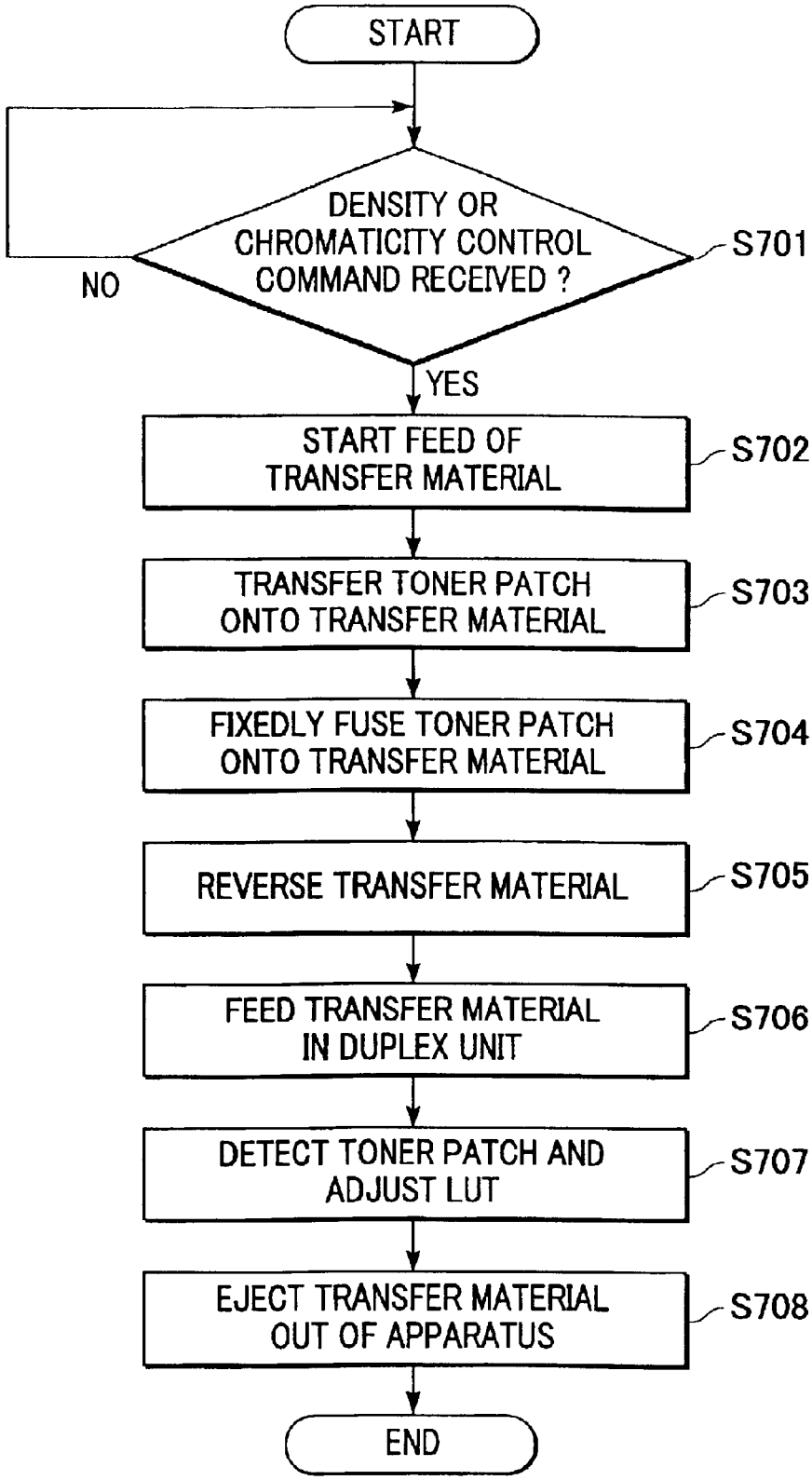
FIG. 7 is a flowchart showing the operation of the image forming apparatus according to the first embodiment of the present invention.

FIG. 7 is a flowchart showing the operation of the image forming apparatus 100 when the toner patch pattern 60 is formed on one side of the transfer material 22 and detected by the color sensor 50.

When the image forming control section 103 receives a control command instructing control of the density or chromaticity from the image processing control section 101 in step S701, it starts feed of the transfer material 22 from the sheet feed section 11 in step S702.

In step S703, the image forming control section 103 executes the control process for transferring the toner image onto the obverse (first) side of the transfer material 22 with the action of the secondary transfer roller 13 as described above.

In step S704, the image forming control section 103 executes the control process for feeding the transfer material 22 to the fusing unit 14 and then fusing and fixing the toner image to the transfer material 22.

In step S705, the image forming control section 103 controls the duplex flapper 16 to take a position (indicated by 16*u* in FIG. 3) in which its fore end is raised. Thereby, the transfer material 22 having the toner image formed thereon is fed to the switchback mechanism 17 so that the transfer material 22 is switched back for reversal from a direction D1 to a direction D2 as shown in FIG. 3.

In step S706, the image forming control section 103 executes the control process for feeding the transfer material 22, which has been reversed through the switchback mechanism 17, in the duplex unit 18.

In step S707, the color sensor 50 detects the toner patch pattern 60 in a position that is set for the detection by the color sensor 50 which exists in the middle of the feed path of the transfer material 22 toward the secondary transfer section T2. Also, the image processing control section 101 adjusts the LUT 102 based on the result received from the color sensor 50 through the image forming control section 103.

In step S708, the image forming control section 103 controls the duplex flapper 16 to take a position (indicated by 16*d* in FIG. 3) in which its fore end is lowered, so that the transfer material 22 is advanced toward the sheet ejecting section 19. The transfer material 22 is thereby introduced to the sheet ejecting section 19.

The color image compensation control executed by the image forming control section 103 and the image processing control section 101 in step S707 will now be described with reference to FIGS. 8 and 9.

First, the toner patch pattern 60 shown in FIG. 5 is described in more detail. The toner patch pattern 60 shown in FIG. 5 is made up of monochrome gray gradation patches 61 (61*a*, 61*b*, 61*c*, 61*d* and 61*e*) of one toner color, i.e., black (K), and process gray gradation patches 62 (62*a*, 62*b*, 62*c*, 62*d* and 62*e*) resulting from mixing three colors, i.e., yellow (Y), magenta (M) and cyan (C).

The process gray gradation patch 62*a* is formed to have the same chromaticity as that of the monochrome gray gradation patch 61*a*, and these patches are successively formed in the feed direction of the transfer material 22 (direction of arrow B in FIG. 5). Likewise, the process gray gradation patch 62*b* and the monochrome gray gradation patch 61*b*, the process gray gradation patch 62*c* and the monochrome gray gradation patch 61*c*, the process gray gradation patch 62*d* and the monochrome gray gradation patch 61*d*, as well as the process gray gradation patch 62*e* and the monochrome gray gradation patch 61*e* are also formed to have the same chromaticity for each pair. Then, the monochrome gray gradation patches 61 (61*a*, 61*b*, 61*c*, 61*d* and 61*e*) have different levels of gradation (density) that are stepwisely increased in the feed direction as shown in FIG. 5 (direction of arrow B in FIG. 5). Further, as with the monochrome gray gradation patches 61, the process gray gradation patches 62 (62*a*, 62*b*, 62*c*, 62*d* and 62*e*) have different levels of gradation (density) that are stepwisely increased in the feed direction.

Although it is desired, as described above, that the amounts of the mixed toners of three YMC colors are set to make each pair of the monochrome gray gradation patch 61 and the process gray gradation patch 62 have the same chromaticity, the chromaticity of the monochrome gray gradation patch 61 and the chromaticity of the process gray gradation patch 62 actually formed on the transfer material 22 are not always coincident with each other. In the image forming apparatus 100, therefore, the amounts of the mixed toners of three YMC colors, i.e., the respective densities of the color toners, are properly adjusted based on the results obtained by the color sensor 50 detecting the monochrome gray gradation patches 61 and the process gray gradation patches 62 so that each pair of the monochrome gray gradation patch 61 and the process gray gradation patch 62 have the same chromaticity.

Figure 8:
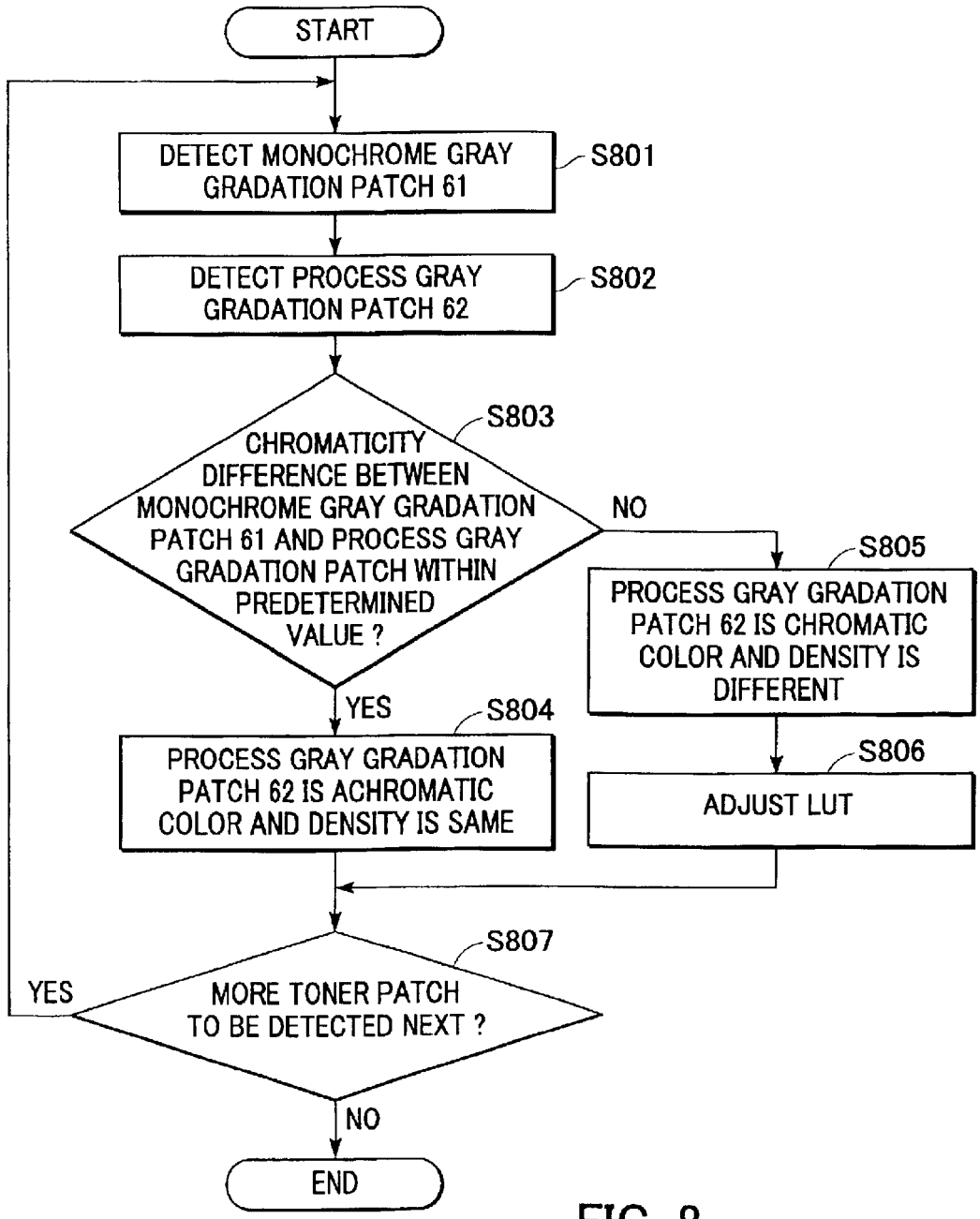
FIG. 8 is a flowchart showing the operation for adjusting the compensation factors set in an LUT.

FIG. 8 is a flowchart showing the operation in which the image forming apparatus 100 adjusts the LUT 102 so as to provide the amounts of the mixed toners of three YMC colors based on the results of detection by the color sensor 50.

In step S801, the color sensor 50 detects the chromaticity of the monochrome gray gradation patch 61*a* on the transfer material 22 that has passed the fusing unit 14 and has the toner patch pattern 60 for chromaticity control.

In step S802, the color sensor 50 detects the chromaticity of the process gray gradation patch 62*a* on the transfer material 22.

In step S803, based on the results detected in steps S801 and S802, the image forming control section 103 compares the chromaticity of the monochrome gray gradation patch 61*a* with the chromaticity of the process gray gradation patch 62*a*, and determines whether the chromaticity difference between the patches 61*a* and 62*a* is within a predetermined value (e.g., within DE3 representing the chromati city difference allowable for the human perception).

If it is determined in step S803 that the chromaticity difference between the monochrome gray gradation patch 61*a* and the process gray gradation patch 62*a* is within the predetermined value, the image processing control section 101 determines in step S804 that the process gray gradation patch 62*a* is achromatic and has the same gradation (density) as that of the process gray gradation patch 62*a*. Then, the process flow advances to the next step without adjusting the LUT 102.

On the other hand, if it is determined in step S803 that the chromaticity difference between the monochrome gray gradation patch 61*a* and the process gray gradation patch 62*a* is not within the predetermined value, the image processing control section 101 determines in step S805 that the process gray gradation patch 62*a* is chromatic or has a different gradation (density) from that of the process gray gradation patch 62*a*. Then, in step S806, the image forming apparatus 100 adjusts the compensation factors in the LUT 102 so as to adjust the amounts of the mixed toners of three colors, i.e., yellow (Y), magenta (M) and cyan (C), forming the process gray gradation patch 62*a*. The adjustment of the LUT 102 is described later in detail with reference to FIG. 9.

In step S807, the image forming control section 103 determines whether there remain the monochrome gray gradation patch 61 and the process gray gradation patch 62 to be next detected by the color sensor 50. If the determination result is "YES", the process flow returns to step S801 and executes the subsequent steps.

By repeating the steps described above, the color sensor 50 detects, subsequent to the pair of the monochrome gray gradation patch 61*a* and the process gray gradation patch 62*a*, the pairs of 61*b* and 62*b*, 61*c* and 62*c*, 61*d* and 62*d*, as well as 61*e* and 62*e*. Correspondingly, the image processing control section 101 adjusts the LUT 102 for each of plural gradations.

In the above description, each time when the color sensor 50 detects one pair of the monochrome gray gradation patch 61 and the process gray gradation patch 62, the image processing control section 101 executes the compensation process. However, it is also possible to first detect the chromaticity of each of all the patches 61 (61*a*, 61*b*, 61*c*, 61*d* and 61*e*) and 62 (62*a*, 62*b*, 62*c*, 62*d* and 62*e*), and to determine in concentrated fashion whether the respective process gray gradation patches 62 are each achromatic and have the same gradation (density).

Also, in step S803, the chromaticity of the process gray gradation patch 62 may be compared with the chromaticity of each of all the monochrome gray gradation patches 61 (61*a*, 61*b*, 61*c*, 61*d* and 61*e*) which have been already measured.

With the above-described method of adjusting the LUT 102, it is possible to determine whether the process gray gradation patches 62 are each achromatic and have the same gradation (density), and to know the density level of each patch 62. Accordingly, sufficient data for performing the density or chromaticity control with high accuracy can be detected without being affected by not only contamination of the sensor due to scattering of paper dust, toners and ink, but also variations in spectroscopic characteristics of the sensor.

Further, the image forming apparatus having good density versus gradation characteristics can be provided by adjusting the LUT 102, i.e., by properly adjusting the amounts of the mixed toners of three colors for each of plural gradations so that the process gray gradation patch formed by mixing the toners of three colors, i.e., yellow, magenta and cyan, becomes achromatic, and then feeding the adjusted results back to the image processing control section 101 for adjustment of the image forming conditions.

Figure 9:
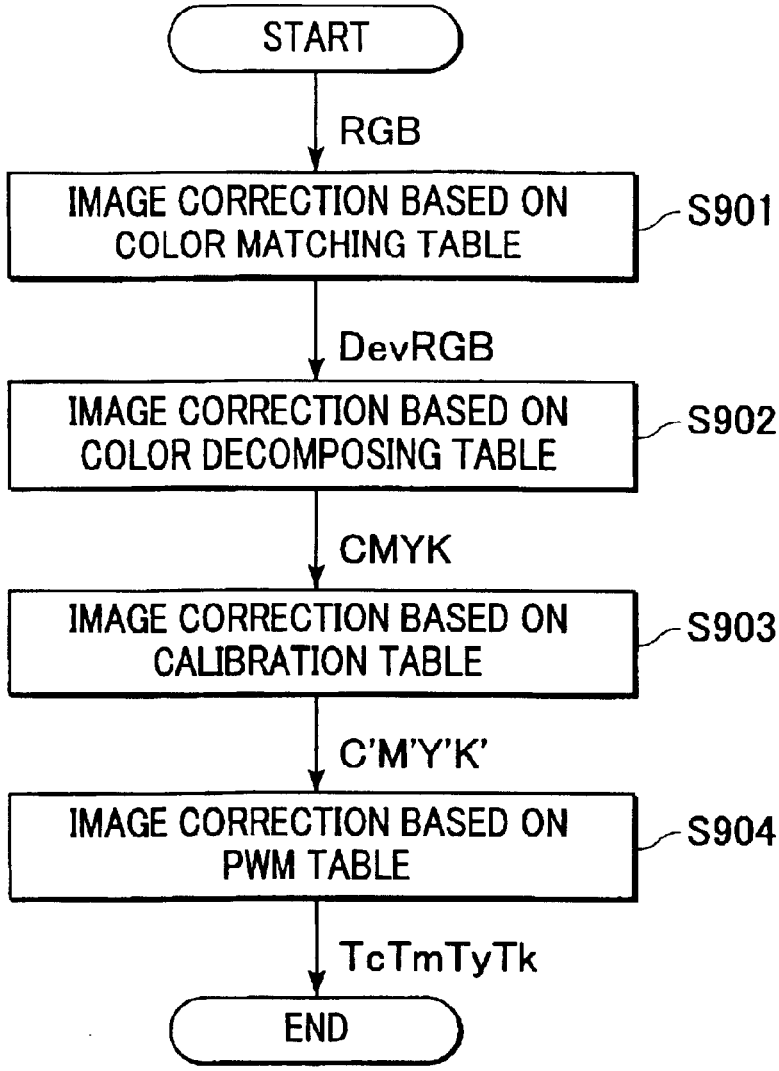
FIG. 9 is a flowchart showing one example of image processing executed in an image processing control section of the image forming apparatus.

FIG. 9 is a flowchart showing one example of image processing executed in the image processing control section 101 of the image forming apparatus 100. It is assumed that various compensation tables, i.e., a color matching table, a color decomposing table, a calibration table and a PWM (Pulse Width Modulation) table, shown in FIG. 9 are included in the LUT 102 of the image forming apparatus 100.

In step S901, the image processing control section 101 modifies, based on the color matching table prepared in advance, an RGB signal representing an image color and transmitted from an external host, such as a personal computer, through computation using the predetermined compensation factors for conversion into a device RGB signal (referred to as a "DevRGB signal" hereinafter) in match with the color reproducible range of the image forming apparatus 100.

In step S902, the image processing control section 101 modifies, based on the color decomposing table prepared in advance, the DevRGB signal through computation using the predetermined compensation factors for conversion into a CMYK signal regarding the colors of toner dyes used in the image forming apparatus 100.

In step S903, the image processing control section 101 converts, based on the calibration table for compensating the density versus gradation characteristics specific to each image forming apparatus 100, the CMYK signal into a C'M'Y'K' signal, which has been modified for compensation of the density versus gradation characteristics, through computation using the predetermined tables for conversion. That conversion is performed by a method of storing C signals for a plurality of gradations (e.g., five gradations a–e) and C' signals corresponding to the C signals, as the calibration table, in the LUT 102 beforehand, and then converting the input C signal into the corresponding C' signal by employing the stored C and C' signals. To explain by way of example, the C signals for the five gradations a–e and the corresponding C' signals are stored, as Ca and C'a, Cb and C'b, Cc and C'c, Cd and C'd, and Ce and C'e, in the LUT 102 beforehand. When converting the input C signal into the corresponding C' signal, the values stored in the calibration table of the LUT 102 are employed. For example, when the C signal at a gradation f between the gradations a and b is input as Cf, the Cf signal is converted into a C'f signal through linear interpolation based on the following formula (1) by using Ca, C'a, Cb and C'b stored in the calibration table of the LUT 102:

$$C'f=Cf.(C'a-C'b)/(Ca-Cb)+(Cb.C'a-Ca.C'b)/(Cb-Ca) \quad (1)$$

While the above description is made of the conversion from the C signal into the C' signal, conversion from an M signal into an M' signal and conversion from a Y signal into Y' signal can also be executed in a similar manner through linear interpolation. As a matter of course, any suitable one of other interpolation methods can also be used instead of the linear interpolation.

In step S904, based on the PWM table, the C'M'Y'K' signal is modified through computation using the predetermined compensation factors for conversion into exposure times Tc, Tm, Ty and Tk for the scanner sections 27C, 27M, 27Y and 27K corresponding to the C'M'Y'K' signal.

Through the above-described steps, the image signal input from the external host is converted into the laser exposure time for the scanner section 27.

The adjustment of the LUT 102 executed in step S806 of FIG. 8 is performed by adjusting the calibration table used in step S903 of FIG. 9. In the conversion from the CMYK signal into the C'M'Y'K' signal using the calibration table, as described above, C signals for a plurality of gradations (e.g., five gradations a–e) and C' signals corresponding to the C signals are stored as the calibration table in the LUT 102. Therefore, the calibration table is adjusted by modifying values of the stored C signals for the plurality of gradations (e.g., five gradations a–e) and values of the stored corresponding C' signals. For example, when the color sensor 50 controlled by the image forming control section 103 determines that the chromaticity difference between the monochrome gray gradation patch 61*a* and the process gray gradation patch 62*a* at the gradation a is not within the predetermined value, information regarding the density or chromaticity is sent to the image processing control section 101 so as to adjust the calibration table in the LUT 102 based on the detected signal input from the color sensor 50. In the image processing control section 101, the values of the C and C'a signals stored as the calibration table in the LUT 102 are modified in accordance with the input information regarding the density or chromaticity. While the above description is made in connection with the gradation a, the calibration table can be adjusted for the other gradations in a similar manner. Further, for the other colors Y and M than C, the calibration table can also be adjusted in a similar manner.

As a result of the adjusting operation described above, the amounts of the mixed toners of C, M and Y are properly adjusted so that the chromaticity difference between the monochrome gray gradation patch 61 and the process gray gradation patch 62 is held within the predetermined value.

In the above-described control method, the image processing control section 101 adjusts the LUT 102 (more precisely, the calibration table in the LUT 102) so that the desired density or chromaticity can be obtained. As another embodiment, a stable image can also be obtained with density or chromaticity control in which, after detecting the density or chromaticity of the toner patch pattern 60, the image forming control section 103 directly controls, for example, the amount of exposure of the laser beam emitted from the scanner section 27 or the developing bias applied from the developing unit 25 depending on the detected result. Alternatively, it is also possible to select, as required, one of the methods of controlling the image forming operation in accordance with the result detected by the color sensor 50 and controlling the density or chromaticity of the image having been fused.

In addition, this embodiment is applicable to the case where the image forming control section 103 detects the toner density patch pattern 44, which is formed on the intermediate transfer member 12, using the photosensor 40 for density control provided separately from the color sensor 50, and the amount of exposure of the laser beam emitted from the scanner section 27 or the developing bias applied from the developing unit 25 is controlled depending on the detected result. In that case, the result detected by the photosensor 40 for density control is modified for each of plural gradations, and the amount of exposure of the laser beam emitted from the scanner section 27 or the developing bias applied from the developing unit 25 is controlled in accordance with the modified detected result. As a result, the amounts of the mixed toners of C, M and Y are properly adjusted so that the chromaticity difference between the monochrome gray gradation patch 61 and the process gray gradation patch 62 is held within the predetermined value.

The switchback mechanism 17 includes feed means such as a feed path for the transfer material 22 and a feed roller (switchback roller) for reversing the transfer material 22 the obverse side down. The duplex unit 18 includes an accommodating section for receiving the transfer material 22 fed from the switchback mechanism 17 and holding it to be ready for the image formation on the reverse side, and feed means such as a feed path and a feed roller for the transfer material 22.

In the first embodiment, the color sensor 50 is disposed in the middle of the transfer-material feed path at a position between the switchback mechanism 17 and the transfer roller 13 (i.e., the secondary transfer section T2) to face the side of the transfer material 22 on which the toner patch pattern 60 is formed. Preferably, as shown in FIG. 3, the color sensor 50 is disposed in the middle of the transfer-material feed path at a position along a region after the transfer material 22 has passed the duplex unit 18 and reached the transfer position in the secondary transfer section T2.

Figure 10:
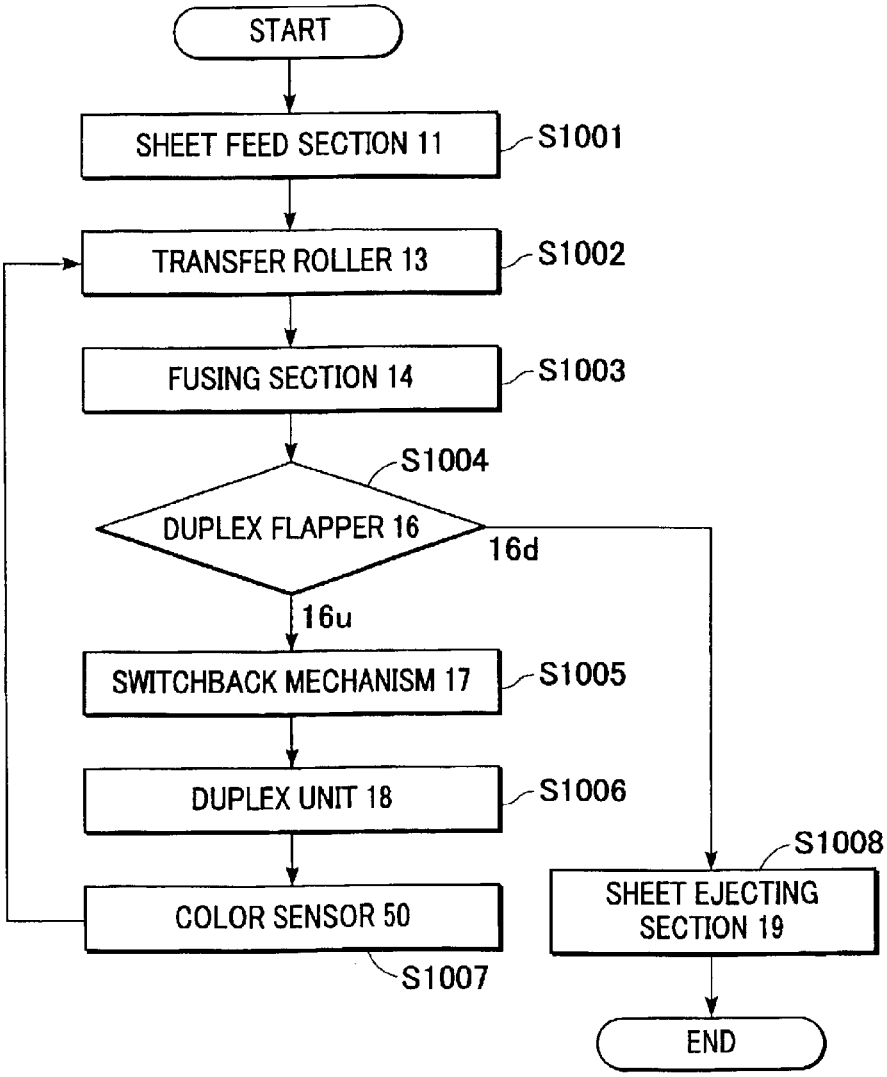
FIG. 10 is a flowchart showing a feed path of a transfer material in the first embodiment of the present invention.

A description is now made of the feed path of the transfer material 22 fed under control of the image forming apparatus 100 with reference to FIG. 10.

FIG. 10 is a flowchart showing the feed path of the transfer material 22 in the first embodiment. The transfer material 22 is fed from the sheet feed section 11 to the transfer roller 13 (S1001), and the toner patch pattern 60 formed as a reference developer image on the intermediate transfer member 12 is transferred onto the transfer material 22 (S1002). While passing through the fusing unit 14, the toner patch pattern 60 is fused and fixed to the transfer material 22 (S1003). The transfer material 22 having the toner patch pattern 60 formed thereon is fed to the switchback mechanism 17 through the duplex flapper 16, and reaches the position of the color sensor 50 via the duplex unit 18 (S1004, S1005, S1006. Then, the color sensor 50 detects the density or chromaticity of the toner patch pattern 60 S1007.

After the detection of the density or chromaticity of the toner patch pattern 60, the transfer material 22 is advanced to the sheet ejecting section 19 via the transfer roller 13, the fusing unit 14, and the duplex flapper 16 (S1008). As described above, this second embodiment is featured in that the color sensor 50 is disposed in the middle of the transfer-material feed path at a position between the switchback mechanism 17 and the transfer roller 13, the transfer material 22 including the toner image having been fused is fed to the position of the color sensor 50 via the switchback mechanism 17 and the duplex unit 18 for detecting the density or chromaticity of the toner patch pattern 60 by the color sensor 50, and after the detection, the transfer material 22 is advanced to the sheet ejecting section 19 via the transfer roller 13 and the fusing unit 14.

So long as an image forming apparatus has the switchback mechanism 17 and the duplex unit 18, the first embodiment is practically feasible just by providing the color sensor 50 in the predetermined position without changing the apparatus structure at all. Also, the color sensor 50 is disposed at a position that is sufficiently away from the fusing unit 14 and is free from the effect of the heat radiated from the fusing unit 14. Further, the time taken for the transfer material 22 to reach the position of the color sensor 50 after the fusing of the toner patch pattern 60 is set such that the transfer material 22 heated by the fusing unit 14 is sufficiently cooled down to a level of temperature at which the color sensor 50 causes neither deformations nor variations of characteristics and hence the detection reliability does not deteriorate.

Thus, with the arrangement of the color sensor 50 and the feed path of the transfer material 22 according to the first embodiment, since the distance between the color sensor 50 and the fusing unit 14 is sufficiently large and the temperature of the transfer material 22 is reduced down while it is fed to the position of the color sensor 50, the color sensor 50 can be prevented from being affected by the heat radiated from the fusing unit 14 and the heat still remaining in the transfer material 22.

Consequently, this first embodiment can realize the density or chromaticity control with high accuracy and high reliability.

(Second Embodiment)

A second embodiment of the present invention will be described below.

The second embodiment is similar to the first embodiment in that the toner patch pattern 60 having the patch array shown in FIG. 5 is employed, but differs in that the toner patch pattern 60 is formed on each of both sides of the transfer material 22 and the density or chromaticity of each of the toner patch patterns 60 on both the sides is detected by the color sensor 50.

The operation of the image forming apparatus 100 according to the second embodiment will be described with reference to a flowchart of FIG. 11.

Figure 11:
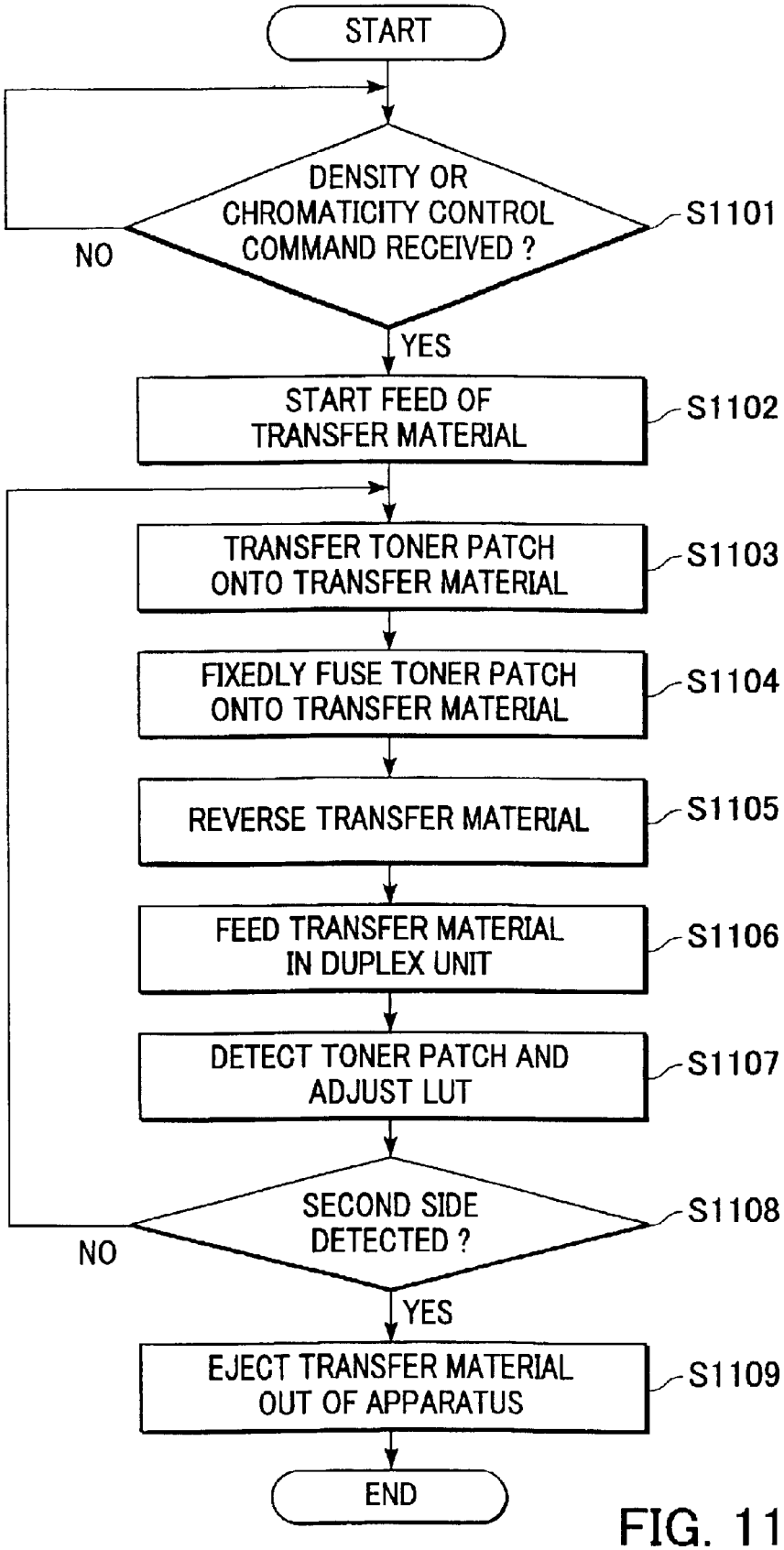
FIG. 11 is a flowchart showing the operation of the image forming apparatus according to the second embodiment of the present invention.

FIG. 11 is a flowchart showing the operation of the image forming apparatus 100 when the toner patch pattern 60 is formed on each of both sides of the transfer material 22 and detected by the color sensor 50.

When the image forming control section 103 receives a control command instructing control of the density or chromaticity from the image processing control section 101 in step S1101, it starts feed of the transfer material 22 from the sheet feed section 11 in step S1102.

In step S1103, the image forming control section 103 executes the control process for transferring the toner image onto the obverse (first) side of the transfer material 22 with the action of the secondary transfer roller 13 as described above.

In step S1104, the image forming control section 103 executes the control process for feeding the transfer material 22 to the fusing unit 14 and then fusing and fixing the toner image to the transfer material 22.

In step S1105, the image forming control section 103 controls the duplex flapper 16 to take a position (indicated by 16*u* in FIG. 3) in which its fore end is raised. Thereby, the transfer material 22 having the toner image formed thereon is fed to the switchback mechanism 17 so that the transfer material 22 is switched back for reversal from a direction D1 to a direction D2 as shown in FIG. 3.

In step S1106, the image forming control section 103 executes the control process for feeding the transfer material 22, which has been reversed through the switchback mechanism 17, in the duplex unit 18.

In step S1107, the color sensor 50 detects the toner patch pattern 60 in a position that is set for the detection by the color sensor 50 which exists in the middle of the feed path of the transfer material 22 toward a secondary transfer section T2. Also, the image processing control section 101 adjusts the compensation factors in the LUT 102 based on the detection result of the density or chromaticity received from the color sensor 50 through the image forming control section 103.

In step S1108, the image forming control section 103 determines whether the color sensor 50 has detected the toner patch pattern 60 formed on the rear (second) side of the transfer material 22. If only the toner patch pattern 60 on the first side has been detected (i.e., if the determination result in step S1108 is "NO"), the process flow returns to step S1103 for transferring the toner patch pattern 60 onto the rear (second) side of the transfer material 22. Thereafter, the operations of steps S1104 to S1107 are repeated.

If it is determined in step S1108 that the toner patch pattern 60 on the second side has already been detected (i.e., if the determination result in step S1108 is "YES"), the process flow advances to step S1109 in which the image forming control section 103 controls the duplex flapper 16 to take a position (indicated by 16*d* in FIG. 3) in which its fore end is lowered, so that the transfer material 22 is advanced toward the sheet ejecting section 19. The transfer material 22 is thereby introduced to the sheet ejecting section 19.

The density or chromaticity control executed by the image forming control section 103 and the image processing control section 101 in step S1107 is the same as that described above in the first embodiment, and hence is not described here.

In the above-described control method, the image processing control section 101 adjusts the LUT 102 so that the desired density or chromaticity can be obtained. As another embodiment, a stable image can also be obtained with density or chromaticity control in which, after detecting the density or chromaticity of the toner patch pattern 60, the image forming control section 103 directly controls, for example, the amount of exposure of the laser beam emitted from the scanner section 27 or the developing bias applied from the developing unit 25 depending on the detected result. Alternatively, it is also possible to select, as required, one of the methods of controlling the image forming operation in accordance with the result detected by the color sensor 50 and controlling the density or chromaticity of the image having been fused.

In addition, this embodiment is applicable to the case where the image forming control section 103 detects the toner density patch pattern 44, which is formed on the intermediate transfer member 12, using the photosensor 40 for density control provided separately from the color sensor 50, and the amount of exposure of the laser beam emitted from the scanner section 27 or the developing bias applied from the developing unit 25 is controlled depending on the detected result. In that case, the result detected by the photosensor 40 for density control is modified for each of plural gradations, and the amount of exposure of the laser beam emitted from the scanner section 27 or the developing bias applied from the developing unit 25 is controlled in accordance with the modified detected result. As a result, the amounts of the mixed toners of C, M and Y are properly adjusted so that the process gray gradation patch becomes achromatic.

The second embodiment has features, in addition to those of the first embodiment, in that the density or chromaticity control can be performed on both sides of the transfer material 22 in the duplex image forming process and the transfer material 22 is fed through the path enabling the density or chromaticity control to be performed on both sides of the transfer material.

Additionally, in order that the density or chromaticity control can be properly performed by forming the toner patch patterns 60 on both sides of the transfer material 22 even when identical images formed on the obverse side and the reverse side have colors slightly different from each other, the image processing control section 101 may be designed such that two sets of compensation factors in the LUT 102 are separately prepared for the obverse (first) side and the reverse (second) side of the transfer material 22, thus allowing the sets of compensation factors in the LUT 102 to be adjusted independently of each other for the obverse side and the reverse side of the transfer material 22.

Moreover, by forming the toner patch patterns 60 having different gradations on both sides of the transfer material 22, the image forming control section 103 can improve the compensation accuracy with an increase in the number of the toner patch patterns for use in adjusting the LUT 102 and hence can improve the compensation accuracy. In that case, since the number of gradations, for each of which the compensation factors in the LUT 102 are adjusted, is doubled in comparison with the case of forming the toner patch pattern 60 on the obverse (first) side alone, the gradation adjustment can be more finely performed.

Thus, with the arrangement of the color sensor 50, the formation of the toner patch patterns 60 on both sides of the transfer material 22, and the feeding method (feed path of the transfer material 22) according to the second embodiment, since the distance between the color sensor 50 and the fusing unit 14 is sufficiently large and the temperature of the transfer material 22 is reduced while it is fed to the position of the color sensor 50, the color sensor 50 can be prevented from being affected by the heat radiated from the fusing unit 14 and the heat still remaining in the transfer material 22. In addition, the density or chromaticity control can be performed on both sides of the transfer material 22 in the process of duplex image forming.

(Third Embodiment)

A third embodiment of the present invention will be described below.

Figure 12:
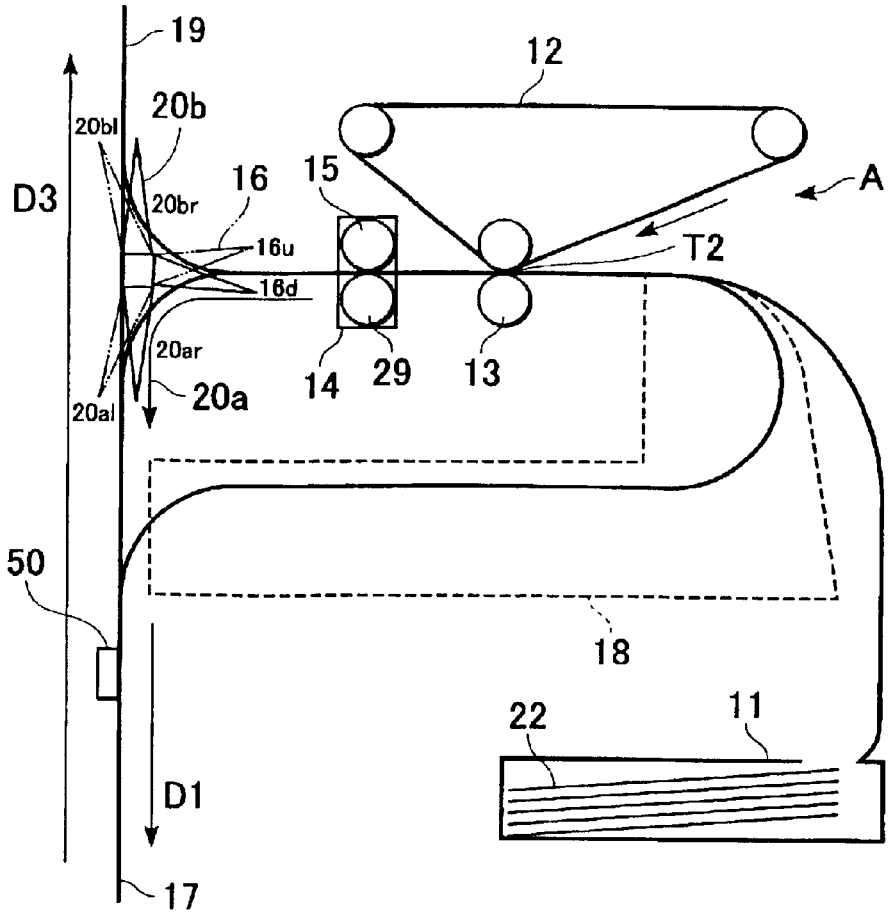
FIG. 12 is a schematic view of an image forming apparatus according to third and fourth embodiments of the present invention.

FIG. 12 is a schematic view of the image forming apparatus 100 according to the third embodiment of the present invention. The third embodiment differs from the first embodiment in that the color sensor 50 is disposed in the switchback mechanism 17 to face the side of the transfer material 22 on which the toner patch pattern 60 is formed. The remaining construction is the same as that of the first embodiment.

As shown in FIG. 12, the image forming apparatus 100 according to the third embodiment includes a duplex flapper 16 and first and second switchback flappers 20*a*, 20*b* which serve as means for changing over the feed path of the transfer material 22 having passed the fusing unit 14. In FIG. 12, when the duplex flapper 16 is in a downward inclined position as indicated by solid lines 16*d* and the second switchback flapper 20*b* is in a leftward inclined position as indicated by two-dot-chain lines 20*b*1, the transfer material 22 is advanced to the sheet ejecting section 19. When the duplex flapper 16 is in an upward inclined position as indicated by two-dot-chain lines 16*u* and the first switchback flapper 20*a* is in a leftward inclined position as indicated by two-dot-chain lines 20*a*1, the transfer material 22 is advanced to the switchback mechanism 17.

Further, in the third embodiment, the image forming control section 103 can control the first and second switchback flappers 20*a*, 20*b* such that the transfer material 22 can be advanced from the switchback mechanism 17 to the sheet ejecting section 19 without passing the duplex unit 18. When the transfer material 22 is advanced from the switchback mechanism 17 to the sheet ejecting section 19, the first and second switchback flappers 20*a*, 20*b* are moved to rightward deviated positions as indicated by solid lines 20*ar*, 20*br* in FIG. 7.

The operation of the image forming apparatus 100 according to the third embodiment will be described with reference to a flowchart of FIG. 13.

Figure 13:
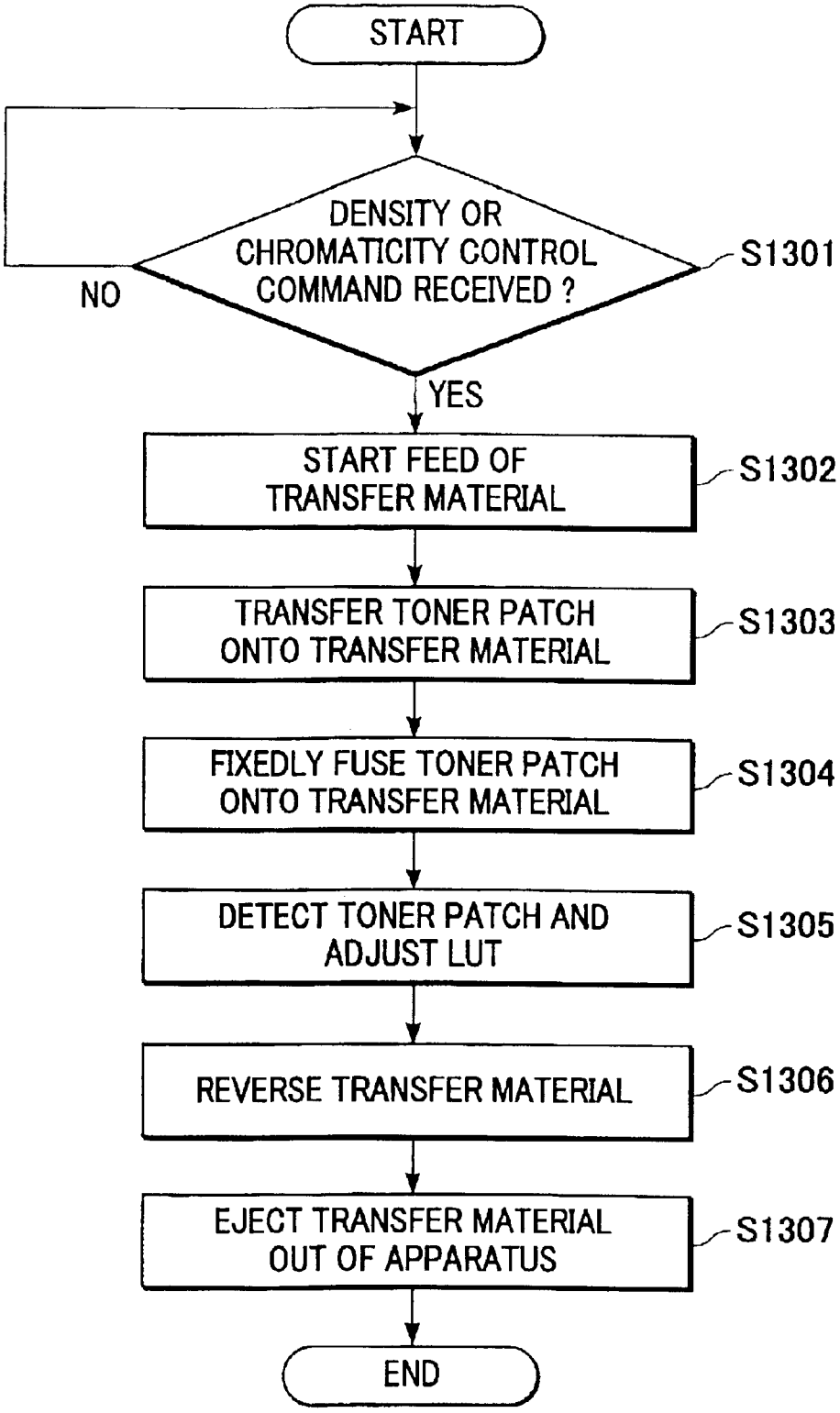
FIG. 13 is a flowchart showing the operation of the image forming apparatus according to the third embodiment of the present invention.

FIG. 13 is a flowchart showing the operation of the image forming apparatus 100 when the toner patch pattern 60 is formed on one side of the transfer material 22 and detected by the color sensor 50.

When the image forming control section 103 receives a signal instructing the formation of the toner patch pattern 60 from the image processing control section 101 in step S1301, it starts feed of the transfer material 22 from the sheet feed section 11 in step S1302.

In step S1303, the image forming control section 103 executes the control process for transferring the toner image onto the obverse (first) side of the transfer material 22 with the action of the secondary transfer roller 13 as described above.

In step S1304, the image forming control section 103 executes the control process for feeding the transfer material 22 to the fusing unit 14 and then fusing and fixing the toner image to the transfer material 22.

In step S1305, the image forming control section 103 controls the duplex flapper 16 to take a position (indicated by 16*u*) in which its fore end is raised. Thereby, the transfer material 22 having the toner image formed thereon is fed to the switchback mechanism 17. The density or chromaticity of the toner patch pattern 60 is detected at the position of the color sensor 50. Then, the image processing control section 101 adjusts the LUT 102 based on the detection result of the density or chromaticity received from the color sensor 50 through the image forming control section 103.

In step S1306, the feed direction of the transfer material 22 is changed over from a direction D1 to a direction D3 shown in FIG. 12 so that the transfer material 22 is reversed and fed toward the switchback flappers 20*a*, 20*b*.

In step S1307, the image forming control section 103 executes the control process for advancing the transfer material 22 to the sheet ejecting section 19.

The density or chromaticity control executed by the image forming control section 103 and the image processing control section 101 in step S1305 is the same as that described above in the first embodiment, and hence is not described here.

In the above-described control method, the image processing control section 101 adjusts the LUT 102 so that the desired density or chromaticity can be obtained. As another embodiment, a stable image can also be obtained with density or chromaticity control in which, after detecting the density or chromaticity of the toner patch pattern 60, the image forming control section 103 directly controls, for example, the amount of exposure of the laser beam emitted from the scanner section 27 or the developing bias applied from the developing unit 25 depending on the detected result. Alternatively, it is also possible to select, as required, one of the methods of controlling the image forming operation in accordance with the result detected by the color sensor 50 and controlling the density or chromaticity of the image having been fused.

In addition, this embodiment is applicable to the case where the image forming control section 103 detects the toner density patch pattern 44, which is formed on the intermediate transfer member 12, using the photosensor 40 for density control provided separately from the color sensor 50, and the amount of exposure of the laser beam emitted from the scanner section 27 or the developing bias applied from the developing unit 25 is controlled depending on the detected result. In that case, the result detected by the photosensor 40 for density control is modified for each of plural gradations, and the amount of exposure of the laser beam emitted from the scanner section 27 or the developing bias applied from the developing unit 25 is controlled in accordance with the modified detected result. As a result, the amounts of the mixed toners of C, M and Y are properly adjusted so that the process gray gradation patch becomes achromatic.

Moreover, as shown in FIG. 12, the color sensor 50 is disposed in the switchback mechanism 17 so as to face the side of the transfer material 22 on which the toner patch pattern 60 is formed.

Figure 14:
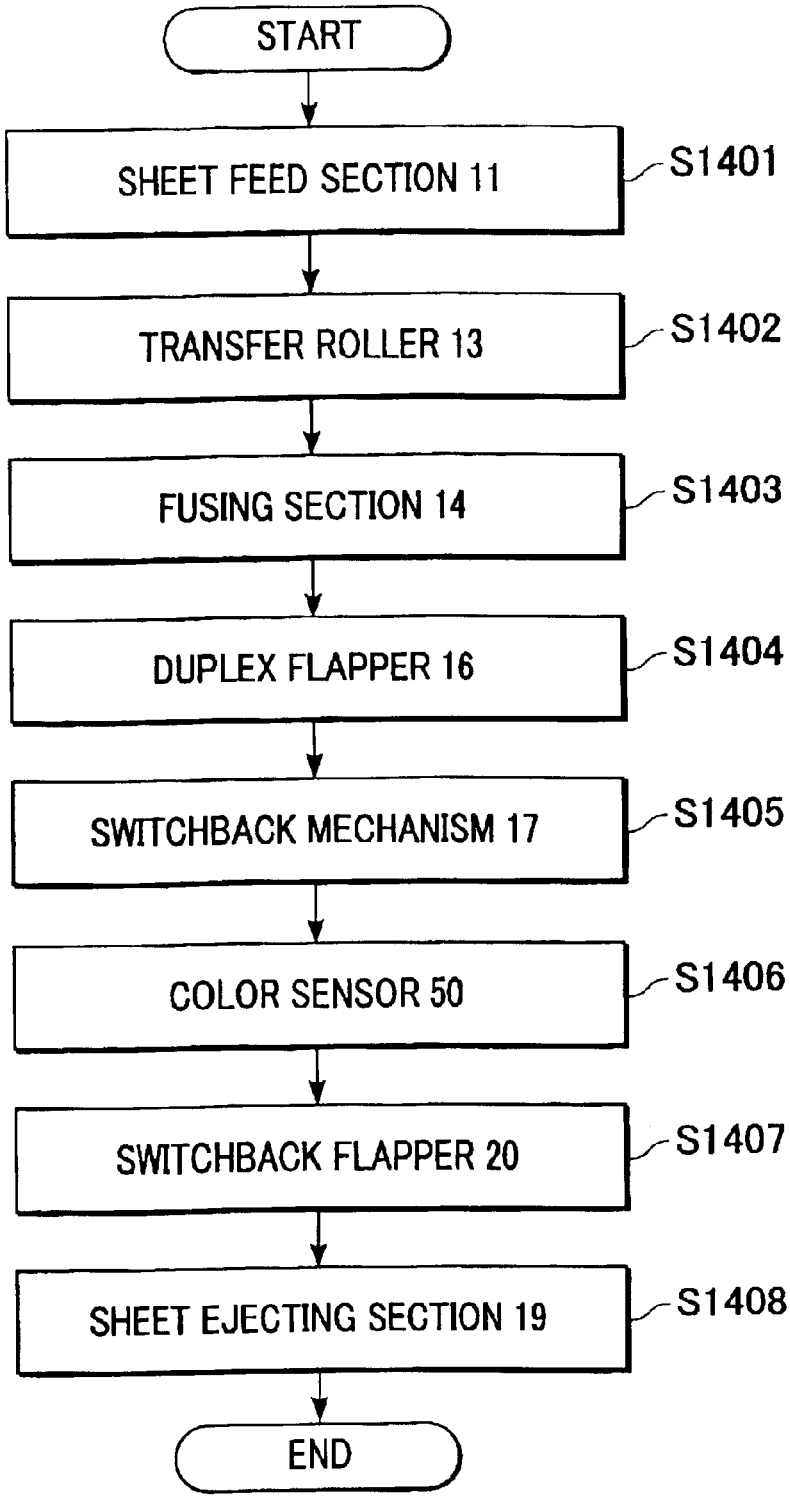
FIG. 14 is a flowchart showing a feed path of a transfer material in the third embodiment of the present invention.

With reference to FIG. 14, a description is now made of the feed path of the transfer material 22 fed under control of the image forming apparatus 100 in accordance with the flowchart of FIG. 13. FIG. 14 is a flowchart showing the feed path of the transfer material 22 in the third embodiment. The transfer material 22 is fed from the sheet feed section 11 to the transfer roller 13 (S1401), and the toner patch pattern 60 formed on the intermediate transfer member 12 is transferred onto the transfer material 22 (S1402). While passing through the fusing unit 14, the toner patch pattern 60 is fused and fixed to the transfer material 22 (S1403). The transfer material 22 having the toner patch pattern 60 formed thereon is advanced to the switchback mechanism 17 with the aid of the duplex flapper 16 (S1404, S1405), and the density or chromaticity of the toner patch pattern 60 is detected by the color sensor 50 disposed in the switchback mechanism 17 (S1406).

After the detection of the density or chromaticity of the toner patch pattern 60, the transfer material 22 is advanced to the sheet ejecting section 19 through the two switchback flappers 20*a*, 20*b* (S1407, S1408).

As described above, this third embodiment is featured in that the color sensor 50 is disposed in the switchback mechanism 17, and that the transfer material 22 is fed to the switchback mechanism 17 and, after the detection of the density or chromaticity, it is advanced to the sheet ejecting section 19 through the two switchback flappers 20*a*, 20*b* without passing the duplex unit 18 and the image forming section A. With those features, the total feed path of the transfer material 22 from the supply to the ejection becomes shorter than that required in the image forming apparatus 100 according to the first embodiment.

The image forming apparatus 100 according to the third embodiment includes, as shown in FIG. 12, not only the switchback mechanism 17, but also the duplex unit 18 similar to that used in the first embodiment, which enables images to be formed on both sides of the transfer material 22. However, the third embodiment is also applicable to an image forming apparatus according employing no duplex unit, so long as the switchback mechanism 17 and the switchback flappers 20*a*, 20*b* are provided and the color sensor 50 is disposed in the switchback mechanism 17.

Also, the color sensor 50 is disposed at a position that is sufficiently away from the fusing unit 14 and is free from the effect of the heat radiated from the fusing unit 14. Further, the time taken for the transfer material 22 to reach the position of the color sensor 50 after the fusing of the toner patch pattern 60 is set such that the transfer material 22 heated by the fusing unit 14 is sufficiently cooled down to a level of temperature at which the color sensor 50 causes neither deformations nor variations of characteristics and hence the detection reliability does not deteriorate. Additionally, since the feed distance of the transfer material 22 is shorter in the third embodiment than in the first embodiment, the time required for a series of control operations in the third embodiment becomes shorter than that in the first embodiment.

Thus, with the arrangement of the color sensor 50 and the feed path of the transfer material 22 according to the third embodiment, since the distance between the color sensor 50 and the fusing unit 14 is sufficiently large and the temperature of the transfer material 22 is reduced while it is fed to the position of the color sensor 50, the color sensor 50 can be prevented from being affected by the heat radiated from the fusing unit 14 and the heat still remaining in the transfer material 22. Moreover, since the total feed path of the transfer material 22 is shortened with the provision of the switchback flappers 20*a*, 20*b*, the detection of the density or chromaticity is completed in a shorter time.

Consequently, this third embodiment can realize the density or chromaticity control in a shorter time with high accuracy and high reliability.

(Fourth Embodiment)

A fourth embodiment of the present invention will be described below.

The fourth embodiment is similar to the third embodiment in that the image forming apparatus has the construction shown in FIG. 12, but differs in that the toner patch pattern 60 is formed on each of both sides of the transfer material 22 and the density or chromaticity of each of the toner patch patterns 60 on both the sides is detected by the color sensor 50.

The operation of the image forming apparatus 100 according to the fourth embodiment will be described with reference to a flowchart of FIG. 15.

Figure 15:
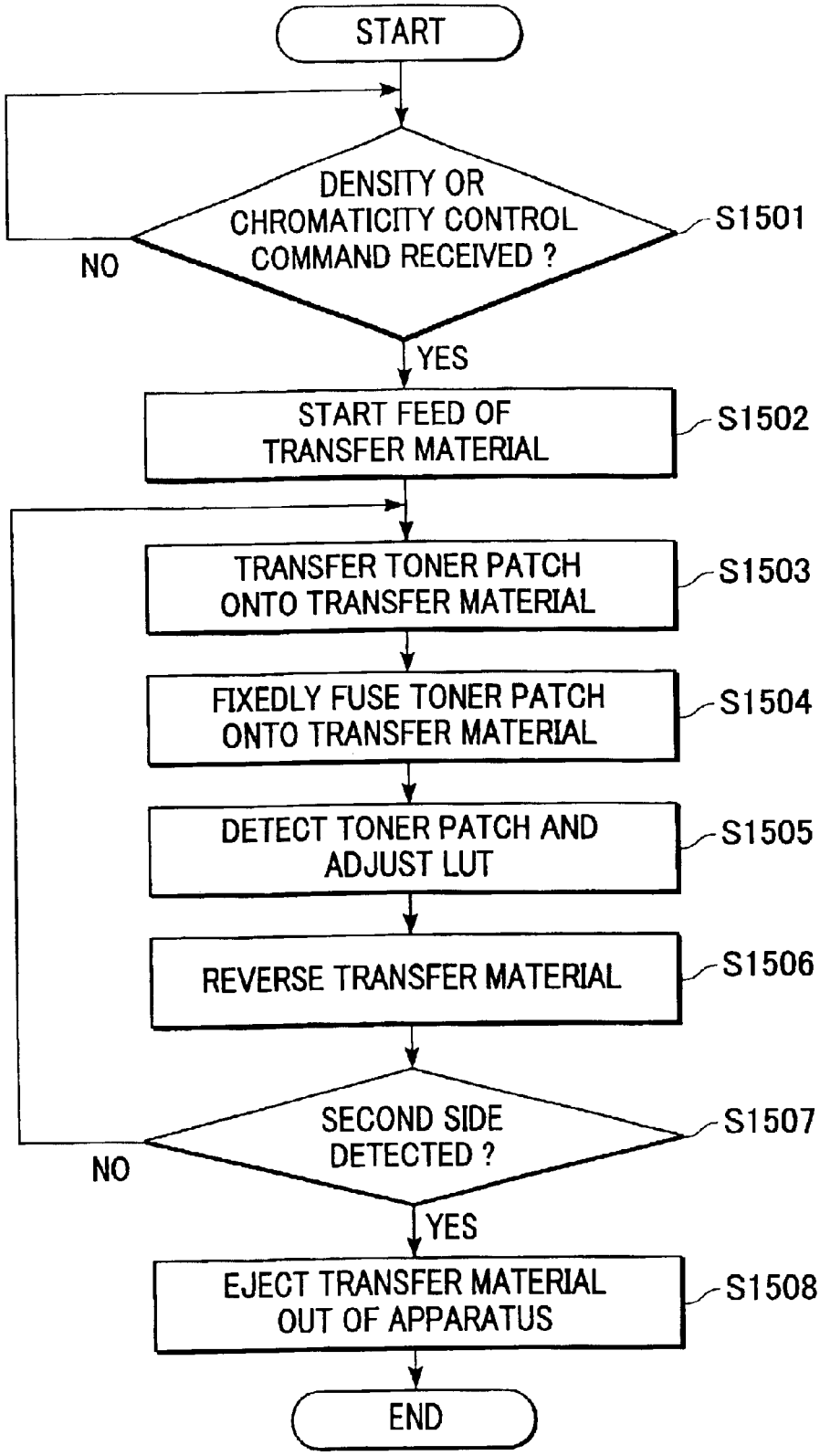
FIG. 15 is a flowchart showing the operation of the image forming apparatus according to the fourth embodiment of the present invention.

FIG. 15 is a flowchart showing the operation of the image forming apparatus 100 when the toner patch pattern 60 is formed on each of both sides of the transfer material 22 and detected by the color sensor 50.

When the image forming control section 103 receives a signal instructing the formation of the toner patch pattern 60 from the image processing control section 101 in step S1501, it starts feed of the transfer material 22 from the sheet feed section 11 in step S1502.

In step S1503, the image forming control section 103 executes the control process for transferring the toner image onto the obverse (first) side of the transfer material 22 with the action of the secondary transfer roller 13 as described above.

In step S1504, the image forming control section 103 executes the control process for feeding the transfer material 22 to the fusing unit 14 and then fusing and fixing the toner image to the transfer material 22.

In step S1505, the image forming control section 103 controls the duplex flapper 16 to take a position (indicated by 16*u*) in which its fore end is raised. Thereby, the transfer material 22 having the toner image formed thereon is fed to the switchback mechanism 17. The density or chromaticity of the toner patch pattern 60 is detected at the position of the color sensor 50. Then, the image processing control section 101 adjusts the LUT 102 based on the detection result of the density or chromaticity received from the color sensor 50 through the image forming control section 103.

In step S1506, the image forming control section 103 controls the switchback mechanism 17 to change over the feed direction of the transfer material 22 so that the transfer material 22 is reversed.

In step S1507, it is determined whether the toner patch pattern 60 formed on the reverse (second) side of the transfer material 22 has been detected. If the toner patch pattern 60 on the second side is not yet detected (i.e., if the determination result in step S1507 is "NO"), the process flow returns to step S1503 and then executes the control operations of steps S1503 to S1507.

More specifically, under control of the image forming control section 103, the toner patch pattern 60 is transferred onto the reverse (second) side of the transfer material 22 when the transfer material 22 passes the transfer roller 13 (S1503). Then, the toner patch pattern 60 is fused and fixed to the transfer material 22 while the transfer material 22 is passing the fusing unit 14 (step S1504). Then, the toner patch pattern 60 formed on the reverse (second) side of the transfer material 22 is detected, and the LUT 102 is adjusted based on the detection result (step S1505). Finally, the feed direction of the transfer material 22 is changed over such that the transfer material is reversed (step S1506).

If it is determined in step S1507 that the toner patch pattern 60 on the second side of the transfer material 22 has already been detected, the process flow advances to step S1508.

In step S1508, the image forming control section 103 executes the control process for advancing the transfer material 22 to the sheet ejecting section 19.

In the above-described control method, the image processing control section 101 adjusts the LUT 102 so that the desired density or chromaticity can be obtained. As another embodiment, a stable image can also be obtained with density or chromaticity control in which, after detecting the density or chromaticity of the toner patch pattern 60, the image forming control section 103 directly controls, for example, the amount of exposure of the laser beam emitted from the scanner section 27 or the developing bias applied from the developing unit 25 depending on the detected result. Alternatively, it is also possible to select, as required, one of the methods of controlling the image forming operation in accordance with the result detected by the color sensor 50 and controlling the density or chromaticity of the image having been fused.

In addition, this embodiment is applicable to the case where the image forming control section 103 detects the toner density patch pattern 44, which is formed on the intermediate transfer member 12, using the photosensor 40 for density control provided separately from the color sensor 50, and the amount of exposure of the laser beam emitted from the scanner section 27 or the developing bias applied from the developing unit 25 is controlled depending on the detected result. In that case, the result detected by the photosensor 40 for density control is modified for each of plural gradations, and the amount of exposure of the laser beam emitted from the scanner section 27 or the developing bias applied from the developing unit 25 is controlled in accordance with the modified detected result. As a result, the amounts of the mixed toners of C, M and Y are properly adjusted so that the process gray gradation patch becomes achromatic.

Additionally, in order that the density or chromaticity control can be properly performed by forming the toner patch patterns 60 on both sides of the transfer material 22 even when identical images formed on the obverse side and the reverse side have colors slightly different from each other, the image processing control section 101 may be designed such that two LUTs 102 are separately prepared for the obverse (first) side and the reverse (second) side of the transfer material 22, thus allowing the two LUTs 102 to be adjusted independently of each other for the obverse side and the reverse side of the transfer material 22.

Moreover, by forming the toner patch patterns 60 having different gradations on both sides of the transfer material 22, the image forming control section 103 can improve the compensation accuracy with an increase in the number of the toner patch patterns for use in adjusting the LUT 102. In that case, since the number of gradations, for each of which the LUT 102 is adjusted, is doubled in comparison with the case of forming the toner patch pattern 60 on the obverse (first) side alone, the gradation adjustment can be more finely performed.

Figure 16:
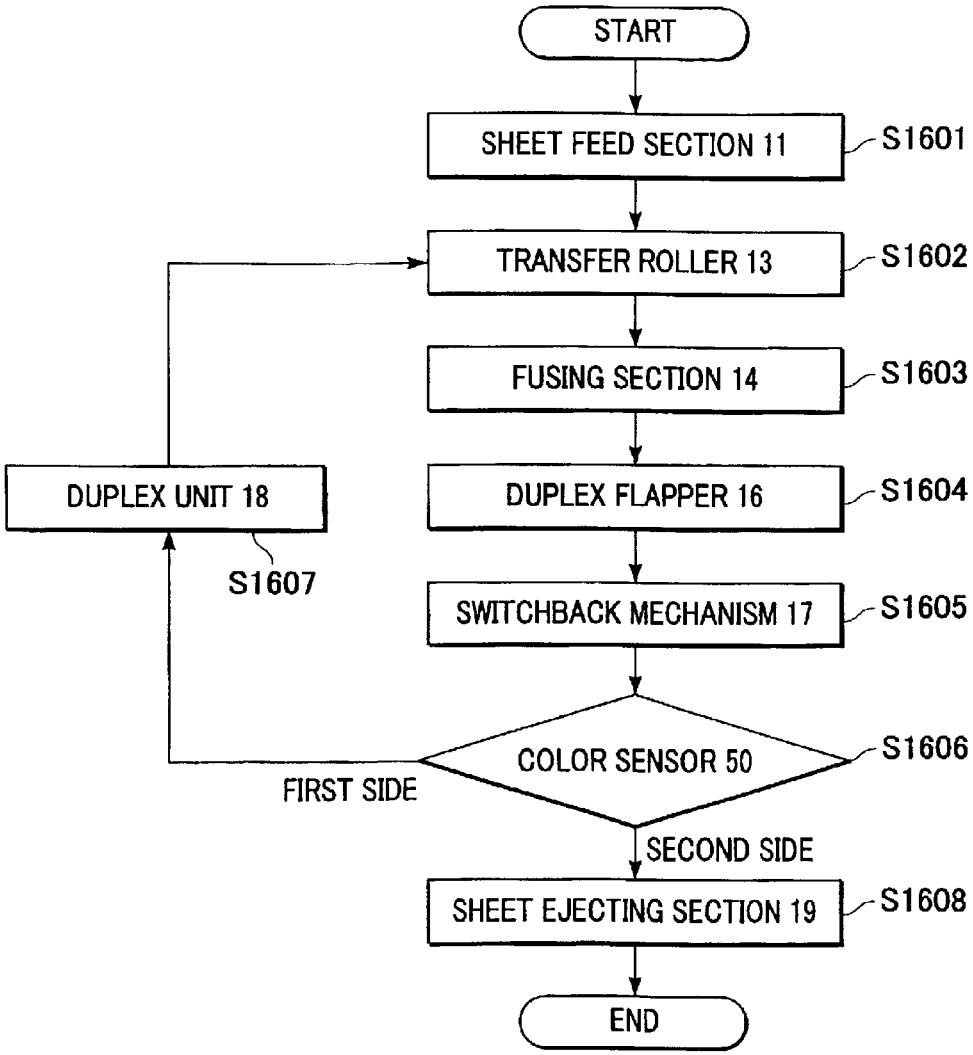
FIG. 16 is a flowchart showing a feed path of a transfer material in the fourth embodiment of the present invention.

With reference to FIG. 16, a description is now made of the feed path of the transfer material 22 fed under control of the image forming apparatus 100 in accordance with the flowchart of FIG. 15.

FIG. 16 is a flowchart showing the feed path of the transfer material 22 in the fourth embodiment. The transfer material 22 is fed from the sheet feed section 11 to the transfer roller 13, and the toner patch pattern 60 formed on the intermediate transfer member 12 is transferred onto the obverse (first) side of the transfer material 22. While passing through the fusing unit 14, the toner patch pattern 60 is fused and fixed to the transfer material 22. The transfer material 22 having the toner patch pattern 60 formed thereon is advanced to the switchback mechanism 17 with the aid of the duplex flapper 16, and the density or chromaticity of the toner patch pattern 60 on the obverse (first) side of the transfer material 22 is detected by the color sensor 50 disposed in the switchback mechanism 17.

After the detection of the density or chromaticity of the toner patch pattern 60 on the obverse side, the transfer material 22 is fed again through the duplex unit 18. Then, the toner patch pattern 60 formed on the intermediate transfer member 12 is transferred onto the reverse (second) side of the transfer material 22. While passing through the fusing unit 14, the toner patch pattern 60 is fused and fixed to the transfer material 22. Subsequently, the transfer material 22 having the toner patch pattern 60 formed thereon is advanced to the switchback mechanism 17 with the aid of the duplex flapper 16, and the density or chromaticity of the toner patch pattern 60 on the reverse (second) side of the transfer material 22 is detected by the color sensor 50 disposed in the switchback mechanism 17.

After the detection of the density or chromaticity of the toner patch pattern 60 on the reverse side, the transfer material 22 is advanced to the sheet ejecting section 19 through the two switchback flappers 20*a*, 20*b*.

As described above, this fourth embodiment has features, in addition to the features of the third embodiment, in that the density or chromaticity control can be performed on both sides of the transfer material 22 in the duplex image forming process, and that after detecting the density or chromaticity of the toner patch pattern 60 formed on each of both sides of the transfer material 22, the transfer material 22 is advanced to the sheet ejecting section 19 through the two switchback flappers 20*a*, 20*b* without passing the image forming section A. Thus, the total feed path of the transfer material 22 becomes shorter than that required in the second embodiment.

Thus, with the arrangement of the color sensor 50, the formation of the toner patch patterns on both sides of the transfer material 22, and the feed path of the transfer material 22 according to the fourth embodiment, since the distance between the color sensor 50 and the fusing unit 14 is sufficiently large and the temperature of the transfer material 22 is reduced while it is fed to the position of the color sensor 50, the color sensor 50 can be prevented from being affected by the heat radiated from the fusing unit 14 and the heat still remaining in the transfer material 22. Further, the density or chromaticity control can be performed on both sides of the transfer material in the duplex image forming process. In addition, since the total feed path of the transfer material 22 is shortened with the provision of the switchback flappers 20*a*, 20*b*, the detection of the density or chromaticity is completed in a shorter time.

Consequently, this fourth embodiment can realize the density or chromaticity control for images on both sides of the transfer material in a shorter time with high accuracy and high reliability.

While the above first to fourth embodiments have been described as applying the present invention to a tandem color image forming apparatus in which the image forming section A includes the plurality of image forming units and the intermediate transfer member 12, the present invention is not limited to that type of apparatus. As well known to those skilled in the art, there are other types of image forming apparatuses. In one type, for example, toner images are successively transferred from a plurality of image carriers, e.g., photoconductors, onto a transfer material supported on a transfer-material feed means, and then fused. In another type, toner images of multiple colors are successively formed on a single image carrier, e.g., a single photoconductor. Thereafter, the toner images are successively transferred onto a transfer material supported on a transfer-material feed means in a superimposed relation, or the toner images are successively transferred onto an intermediate transfer member in a superimposed relation and then transferred onto a transfer material together. The present invention can be likewise applied to those image forming apparatuses and can provide similar advantages as those described above.

According to the embodiments, as described above, the density or chromaticity of an image having been formed on a transfer material 22 and fused can be stably detected and controlled with high accuracy and high reliability without being affected by the heat attributable to that the surroundings of the fusing unit 14 are heated to very high temperature due to the heat generated from the fusing unit 14 itself and the transfer material 22 immediately after the fusing is heated to high temperature by the fusing unit 14.

Further, according to the embodiments, image forming apparatuses having the following advantages in addition to the above-mentioned advantages can be provided. In one apparatus, the density or chromaticity of an image having been formed on a transfer material and fused can be detected and controlled in a shorter time. In another apparatus, the density or chromaticity of an image having been formed on each of both sides of a transfer material and fused can be detected and controlled. In still another apparatus, the density or chromaticity of an image having been formed on each of both sides of a transfer material and fused can be detected and controlled in a shorter time.

(Other Embodiments)

With the first to fourth embodiments described above, in the electrophotographic image forming apparatus, the chromaticity and/or gradation of an image is properly controlled by forming and fusing the toner patch pattern 60 on the transfer material 22, detecting the toner patch pattern 60 by the color sensor 50, and adjusting the LUT 102.

However, the present invention is also applicable to an ink jet image forming apparatus in addition to the electrophotographic image forming apparatus. In other words, the chromaticity and/or gradation of an image can also be properly controlled by ejecting inks of multiple colors toward a recording medium in response to image signals from an image forming section, such as an ink head, to thereby form an ink patch pattern on the recording medium, detecting the ink patch pattern by the color sensor 50, and adjusting the LUT 102.

In that case, similar advantages to those in the first to fourth embodiments can be obtained by arranging the image forming section, such as an ink head, in the same position as the image forming section A shown in FIG. 3 or 12, and arranging the color sensor 50 which exists in the middle of a transfer-material feed path at a position within a region from the switchback mechanism 17 to the image forming section A as shown in FIG. 3, or in the switchback mechanism 17 as shown in FIG. 12. Additionally, the ink jet image forming apparatus can be implemented in the form including the fusing unit 14 shown in FIGS. 3 and 12, or including no fusing unit 14.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

image forming means for forming a toner image on an image carrier;

transfer means for transferring the toner image formed by said image forming means onto a transfer material in a transfer position;

fusing means for fusing the toner image transferred by said transfer means on the transfer material;

reversing means for reversing the transfer material having the toner image fused by said fusing means;

duplex feed means for feeding the transfer material reversed by said reversing means to the transfer position;

detecting means for detecting, in a predetermined detecting position, at least one of density and chromaticity of the toner image fused on the transfer material by said fusing means, the predetermined detecting position being a certain position in the middle of a feed path within a region after the transfer material has passed said duplex feed means but until reaching the transfer position; and control means for controlling said image forming means based on a result detected by said detecting means.

2. An image forming apparatus according to claim 1, further comprising ejecting means for ejecting the transfer material from said image forming apparatus, wherein said ejecting means ejects the transfer material from said image forming apparatus after a first side of the transfer material, on which the toner image is formed, has been detected by said detecting means.

3. An image forming apparatus according to claim 2, wherein said ejecting means ejects the transfer material from said image forming apparatus after the first side of the transfer material has been detected by said detecting means and after a second side of the transfer material, on which the toner image is formed, has been detected by said detecting means.

4. An image forming apparatus according to claim 3, wherein said image forming means forms a plurality of reference toner images having different gradations on each of the first side and the second side of the transfer material, and said control means controls said image forming means based on results of detecting the plurality of reference toner images by said detecting means.

5. An image forming apparatus according to claim 1, wherein said image forming means comprises an image forming section for forming the toner image on said image carrier, and an image processing section for modifying an image signal, which is to be used for image formation, through computation using predetermined compensation factors, and transmitting the modified image signal to said image forming section, and said control means adjusts the compensation factors used in the computation for modifying the image signal based on the result detected by said detecting means.

6. An image forming apparatus according to claim 1, wherein said image carrier is an intermediate transfer member, and said image forming means has a plurality of image forming sections each comprising a photoconductor and developing means for developing an electrostatic latent image on the photoconductor with a developer, so that said image forming means is able to form a color toner image by successively superimposing toner images of multiple colors on said intermediate transfer member.

7. An image forming apparatus according to claim 1, wherein said image carrier is a photoconductor, said image forming means has a plurality of image forming sections each including developing means for developing an electrostatic latent image on the photoconductor with a developer, the toner images developed on the photoconductor by said image forming sections are successively transferred onto an intermediate transfer member in a superimposed relation, and said transfer means forms a color toner image on the transfer material by transferring, onto the transfer material, the toner images transferred to said intermediate transfer member.

8. An image forming apparatus comprising:

image forming means for forming a toner image on an image carrier;

transfer means for transferring the toner image formed by said image forming means onto a transfer material in a transfer position;

fusing means for fusing the toner image transferred by said transfer means on the transfer material;

reversing means including a switchback mechanism for reversing the transfer material having the toner image fused by said fusing means;

detecting means for detecting, in a predetermined detecting position, at least one of density and chromaticity of the toner image fused on the transfer material by said fusing means, the predetermined detecting position being a certain position within said switchback mechanism; and control means for controlling said image forming means based on a result detected by said detecting means.

9. An image forming apparatus according to claim 8, further comprising ejecting means for ejecting the transfer material from said image forming apparatus, wherein said ejecting means ejects the transfer material from said image forming apparatus after a first side of the transfer material, on which the toner image is formed, has been detected by said detecting means.

10. An image forming apparatus according to claim 9, wherein said ejecting means ejects the transfer material from said image forming apparatus after the first side of the transfer material has been detected by said detecting means and after a second side of the transfer material, on which the toner image is formed, has been detected by said detecting means.

11. An image forming apparatus according to claim 10, wherein said image forming means forms a plurality of reference toner images having different gradations on each of the first side and the second side of the transfer material, and said control means controls said image forming means based on results of detecting the plurality of reference toner images by said detecting means.

12. An image forming apparatus according to claim 8, wherein said image forming means comprises an image forming section for forming the toner image on said image carrier, and an image processing section for modifying an image signal, which is to be used for image formation, through computation using predetermined compensation factors, and transmitting the modified image signal to said image forming section, and said control means adjusts the compensation factors used in the computation for modifying the image signal based on the result detected by said detecting means.

13. An image forming apparatus according to claim 8, wherein said image carrier is an intermediate transfer member, and said image forming means has a plurality of image forming sections each comprising a photoconductor and developing means for developing an electrostatic latent image on the photoconductor with a developer, so that said image forming means is able to form a color toner image by successively superimposing toner images of multiple colors on said intermediate transfer member.

14. An image forming apparatus according to claim 8, wherein said image carrier is a photoconductor, said image forming means has a plurality of image forming sections each including developing means for developing an electrostatic latent image on the photoconductor with a developer, the toner images developed on the photoconductor by said image forming sections are successively transferred onto an intermediate transfer member in a superimposed relation, and said transfer means forms a color toner image on the transfer material by transferring, onto the transfer material, the toner images transferred to said intermediate transfer member.

15. An image forming apparatus comprising:

image forming means for forming an image of multiple colors on a recording medium;

feed-direction changing means for changing over a feed direction of the recording medium from a first direction to a second direction different from the first direction, causing the recording medium having the image formed by said image forming means to be reversed;

detecting means for detecting, in a predetermined detecting position, chromaticity of the image formed on the recording medium by said image forming means, the predetermined detecting position being a certain position in the middle of a feed path within a region until reaching said image forming means, along which the recording medium is fed after the feed direction of the recording medium has been changed over to the second feed direction by said feed-direction changing means; and control means for controlling said image forming means to adjust color density for each of the multiple colors based on the chromaticity of the image of the multiple colors detected by said detecting means.

16. An image forming apparatus according to claim 15, further comprising ejecting means for ejecting the recording medium from said image forming apparatus, wherein said ejecting means ejects the recording medium from said image forming apparatus after a first side of the recording medium, on which the image is formed, has been detected by said detecting means.

17. An image forming apparatus according to claim 16, wherein said ejecting means ejects the recording medium from said image forming apparatus after the first side of the recording medium has been detected by said detecting means and after a second side of the recording medium, on which the image is formed, has been detected by said detecting means.

18. An image forming apparatus according to claim 17, wherein said image forming means forms a plurality of reference images having different gradations on each of the first side and the second side of the recording medium, and said control means controls said image forming means based on results of detecting the plurality of reference images by said detecting means.

19. An image forming apparatus according to claim 15, wherein said image forming means comprises an image forming section for forming the image on the recording medium, and an image processing section for modifying an image signal, which is to be used for image formation, through computation using predetermined compensation factors, and transmitting the modified image signal to said image forming section, and said control means adjusts, based on the result detected by said detecting means, the compensation factors used in the computation executed by said image forming section for modifying the image signal so as to adjust color density for each of the multiple colors.

20. An image forming apparatus comprising:

an image forming section for forming an image of multiple colors on a recording medium;

feed-direction changing section for changing over a feed direction of the recording medium from a first direction to a second direction different from the first direction, causing the recoding medium fed from said image forming section to be reversed;

a sensor for detecting, in a predetermined detecting position, chromaticity of the image formed on the recording medium by said image forming section, the predetermined detecting position being a certain position in the middle of a feed path within a region until reaching said image forming section, along which the recording medium is fed after the feed direction of the recording medium has been changed over to the second feed direction by said feed-direction changing section; and a controller for receiving information regarding the chromaticity of the image of the multiple colors detected by said sensor and controlling said image forming section to adjust color density for each of the multiple colors based on the information.

* * * * *